US008741525B2

(12) United States Patent
Wada et al.

(10) Patent No.: US 8,741,525 B2
(45) Date of Patent: Jun. 3, 2014

(54) RESIN COATED CARRIER, TWO-COMPONENT DEVELOPER, DEVELOPING DEVICE AND IMAGE FORMING APPARATUS

(75) Inventors: Osamu Wada, Osaka (JP); Takanori Kamoto, Osaka (JP); Tadashi Iwamatsu, Osaka (JP); Nobuyuki Yoshioka, Osaka (JP); Hiroyuki Hirakawa, Osaka (JP); Yoshinori Mutoh, Osaka (JP); Takashi Hara, Osaka (JP); Hirofumi Kanda, Osaka (JP); Yoshio Ichii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 895 days.

(21) Appl. No.: 12/495,973

(22) Filed: Jul. 1, 2009

(65) Prior Publication Data

US 2010/0003614 A1 Jan. 7, 2010

(30) Foreign Application Priority Data

Jul. 4, 2008 (JP) ..... P2008-176385

(51) Int. Cl.
*G03G 9/00* (2006.01)

(52) U.S. Cl.
USPC ..... 430/111.4; 430/111.1; 430/111.2; 430/111.3

(58) Field of Classification Search
CPC ..... G03G 9/1075
USPC ..... 430/106.1, 106.2, 106.3, 111.1–111.41
See application file for complete search history.

(56) References Cited

U.S. PATENT DOCUMENTS

| | | | | |
|---|---|---|---|---|
| 6,040,102 | A | 3/2000 | Takahashi et al. | |
| 6,514,654 | B1 * | 2/2003 | Kanbayashi et al. | 430/122.2 |
| 2006/0063085 | A1 | 3/2006 | Lee et al. | |
| 2006/0251982 | A1 | 11/2006 | Iwatsuki et al. | |
| 2008/0014514 | A1 * | 1/2008 | Kamoto | 430/45.56 |
| 2008/0138732 | A1 * | 6/2008 | Lai et al. | 430/109.3 |
| 2008/0138734 | A1 * | 6/2008 | Inoue et al. | 430/110.2 |

FOREIGN PATENT DOCUMENTS

| | | | |
|---|---|---|---|
| CN | 1752853 | A | 3/2006 |
| CN | 1845010 | A | 10/2006 |
| JP | 7-160059 | A | 6/1995 |
| JP | 7-72810 | | 8/1995 |
| JP | 9-288384 | | 11/1997 |
| JP | 10-161353 | | 6/1998 |
| JP | 2001-125318 | | 5/2001 |
| JP | 2003-005452 | A | 1/2003 |
| JP | 2004-126623 | A | 4/2004 |
| JP | 2005-352130 | A | 12/2005 |
| JP | 2006-330387 | A | 12/2006 |

* cited by examiner

*Primary Examiner* — Mark F Huff
*Assistant Examiner* — Rashid Alam
(74) *Attorney, Agent, or Firm* — Nixon & Vanderhye P.C.

(57) ABSTRACT

The resin coated carrier is used with a toner in which an external additive having an average primary particle size of 50 nm or more is added to a toner particle, and has a carrier core and a resin coating layer on the surface of the carrier core. In the resin coated carrier, the following expression (1) is satisfied:

$$0.5 \leq -\log\{(A/C)/(B/C)\} \leq 2.5 \quad (1)$$

wherein A represents a volume resistance value (Ω/cm) of the resin coated carrier in an electric field of 1000 V/cm that is obtained by conducting a stirring test, B represents a volume resistance value (Ω/cm) of the resin coated carrier in an electric field of 1000 V/cm before the stirring test, and C represents a volume resistance value (Ω/cm) of the carrier core in an electric field of 1000 V/cm.

8 Claims, 3 Drawing Sheets

RESIN COATED CARRIER, TWO-COMPONENT DEVELOPER, DEVELOPING DEVICE AND IMAGE FORMING APPARATUS

CROSS-REFERENCE TO RELATED APPLICATION

This application claims priority to Japanese Patent Application No. 2008-176385, which was filed on Jul. 4, 2008, the contents of which are incorporated herein by reference in its entirety.

BACKGROUND OF THE INVENTION

1. Field of the Invention

The present invention relates to a resin coated carrier used in an electrophotographic image forming apparatus for developing an electrostatic latent image formed on an image bearing member to visualize, a two-component developer including the resin coated carrier, a developing device using the two-component developer and an image forming apparatus.

2. Description of the Related Art

Image output devices employing an electrophotographic technology such as printers and copiers use, as a developer for developing an electrostatic latent image formed on an image bearing member to form a visible image, a two-component developer consisting of a toner and a carrier or a one-component developer consisting of a toner alone, for example. A magnetic brush development method that uses the two-component developer among them is excellent in image quality and high-speed printing compared to other development methods, and is therefore widely used.

An image forming apparatus using the magnetic brush development method is provided with a developer bearing member comprising, for example, a cylindrical-shaped metal sleeve and a magnet roller inside of which permanent magnets are provided as a magnetic field generating section with a N pole and a S pole arranged alternately. By causing the surface of the metal sleeve of the developer bearing member to carry the two-component developer and rotating only the metal sleeve with the magnet roller fixed, it is possible to transport the two-component developer to a development area that faces an image bearing member on which an electrostatic latent image has been formed. A development electric field applied between the developer bearing member and the image bearing member causes only a charged toner to electrostatically attach to the image bearing member to form a visible image.

The toner in the two-component developer is mixed and stirred with the carrier in a development unit including the developer bearing member so as to be charged through contact friction. In dry two-component development, an electrostatic force of the frictionally charged toner is used for electrically handling to form a visible image on the image bearing member, and it is therefore important to control a charge amount of the toner. Although the charge amount of the toner varies depending on various conditions in a system, it is desirable that a value of the charge amount of the toner is stabilized for stability of the system.

Furthermore, high-quality and high-speed printing tends to be considered as important in copiers and printers in recent years. In this case, charge stability of the developer becomes particularly important. To achieve formation of a high-quality image, it is necessary to arrange a determined amount of the toner to a determined place. In the electrophotographic method, handling of the toner is performed by an electrostatic force, and the toner is required to maintain high charge at a certain level or more so that the toner overpowers other external forces such as an adhesive force to be transported by an electric field. In addition, since the number of print sheets is increased with increase in speed of an image forming apparatus, it is strongly demanded to reduce the number of times or the labor of the maintenance and a developer that operates stably over a long term is desired.

For such a demand, the carrier needs to frictionally charge the toner to a desirable polarity and to a desirable charge amount over a long term constantly. The carrier generally used in the two-component developer for charging the toner is different from the toner and stays in the development unit for a long term, it is concerned that the charge applying capability is reduced due to toner spent or stress from stirring and mixing. In addition, there is also a concern that toner scattering resulting therefrom causes contamination in an image forming apparatus. Accordingly, a highly-durable carrier that withstands degradation over time and that is capable of stably maintaining the charge amount of the toner over a long term is required.

In order to meet such a demand for the carrier, a resin coated carrier having the carrier surface coated with a resin has been proposed. Specific examples thereof include a resin coated carrier having the carrier surface coated with a styrene-acrylic copolymer resin or a polyurethane resin each having high surface energy, and a resin coated carrier having the carrier surface coated with a fluorine resin having low surface energy. The styrene-acrylic copolymer resin and the polyurethane resin having high surface energy have great adhesiveness to a carrier core, but have a drawback that the toner is easily spent, whereas the fluorine resin having low surface energy has poor adhesiveness to a carrier core although being effective against the toner-spent, and therefore, there is a drawback that the resin coating layer separates from the carrier core in stirring in the development tank and stable charging is inhibited.

For the purpose of solving the drawbacks, many resin coated carriers having the carrier surface coated with a resin coating layer including a silicone resin have been proposed conventionally, however, even in the resin coated carrier including a silicone resin, the resin coating layer is scraped due to long-term use, thus a problem that charging performance of the carrier varies fails to be solved completely.

To solve such problems, for example, Japanese Examined Patent Publication JP-B2 7-72810 (1995) discloses an electrophotographic two-component developer in which a toner, a resin coated carrier and a carrier core satisfy $0.18 \leq T_2/T_1 \leq 0.77$ (wherein, $T_1$ represents a friction charge amount of the carrier core before being coated with a resin and the toner, an absolute value of $T_1$ is 15.1 to 30.2 μC/g, $T_2$ represents a friction charge amount of the resin coated carrier and the toner, the friction charge amounts $T_1$ and $T_2$ have the same polarity, and the friction charge amount $T_2$ is lower than the friction charge amount $T_1$ by 3.5 μC/g or more in an absolute value) so that the charging performance can be stabilized even when the resin coating layer is scraped.

Further, Japanese Unexamined Patent Publication JP-A 9-288384 (1997) discloses a magnetic carrier in which a ratio of a saturated charge amount of a toner with a resin coated carrier to the saturated charge amount of the toner with only magnetic core particles falls within the range of 0.78 to 1.1.

With the advancement of a full-color image forming apparatus in recent years, a lot of improvements to a toner have been conducted, and a part of which is an improvement to toner external additives. The toner external additive has a function of providing fluidity for the toner and a function of an agent for assisting control for the charge amount of the toner. In a full-color image forming apparatus, an external additive having a large particle size, specifically having an average primary particle size of 50 nm or more, tends to be added for the purpose of improving toner transfer efficiency. However, when a developer composed of a toner to which the external additive having a large particle size added and a carrier, is used over a long term, the external additive having a large particle size is attached to the surface of the carrier and easily accumulated thereon so that normal friction charge of the toner and the carrier is prevented to reduce the charge applying capability of the carrier. Accordingly, in the case of using the toner to which the external additive having a large particle size added for a two-component developer, it is difficult to stably charge the toner over the long term.

With respect to such a problem, the electrophotographic two-component developer disclosed in JP-B2 7-72810 and the magnetic carrier disclosed in JP-A 9-288384 are not capable of suppressing the reduction of the charge applying capability of the carrier over the long term when being used with the toner to which the external additive having a large particle size added, thus reducing charging stability of the toner.

SUMMARY OF THE INVENTION

An object of the invention is to provide a resin coated carrier capable of stably charging a toner to which an external additive having a large particle size is added over a long term, a two-component developer including the resin coated carrier, a developing device capable of forming a high-quality image without fog over a long term by using the two-component developer, and an image forming apparatus.

The invention provides a resin coated carrier comprising a carrier core and a resin coating layer on a surface of the carrier core, the resin coated carrier being used with a toner in which an external additive having an average primary particle size of 50 nm or more is added to a toner particle, wherein the following expression (1) is satisfied:

$$0.5 \leq -\log\{(A/C)/(B/C)\} \leq 2.5 \quad (1)$$

in which A represents a volume resistance value (Ω/cm) of the resin coated carrier in an electric field of 1000 V/cm that is obtained by conducting a stirring test, B represents a volume resistance value (Ω/cm) of the resin coated carrier in an electric field of 1000 V/cm before the stirring test, and C represents a volume resistance value (Ω/cm) of the carrier core in an electric field of 1000 V/cm.

According to the invention, a resin coated carrier is used with a toner in which an external additive having an average primary particle size of 50 nm or more is added to a toner particle, and has a carrier core and a resin coating layer on a surface of the carrier core. In the resin coated carrier, the above expression (1) is satisfied, in which A represents a volume resistance value (Ω/cm) of the resin coated carrier in an electric field of 1000 V/cm that is obtained by conducting a stirring test, B represents a volume resistance value (Ω/cm) of the resin coated carrier in an electric field of 1000 V/cm before the stirring test, and C represents a volume resistance value (Ω/cm) of the carrier core in an electric field of 1000 V/cm. By using the toner to which the external additive having an average primary particle size of 50 nm or more is added, it is possible to improve transfer efficiency, particularly in a color toner, compared to a case where a toner to which an external additive having an average primary particle size of less than 50 nm is added. On the surface of the resin coated carrier to which the external additive having a large particle size, an average primary particle size of which is 50 nm or more, is added, the resin coating layer is properly scraped by stirring in a development tank to be renewed to a resin coating layer to which the external additive is not attached. Since the volume resistance values of the resin coated carrier and the carrier core satisfy the expression (1), reduction of the charge applying capability of the carrier can be suppressed even when the resin coating layer is scraped. Accordingly, it is possible to realize a carrier that is excellent in transfer efficiency and capable of stably charging a toner over a long term even with an increase in the number of print sheets.

Further, in the invention, it is preferable that the resin coated carrier is used with a toner to which at least one of external additives having a smaller average primary particle size than the external additive, as well as the external additive having an average primary particle size of 50 nm or more, are added.

According to the invention, the resin coated carrier is used with a toner to which at least one of external additives having a smaller average primary particle size than the external additive, as well as the external additive having an average primary particle size of 50 nm or more, are added. Thereby, mixing property of the toner particle with the external additive having an average primary particle size of 50 nm or more in an external-additive treatment is improved so that the external additive having an average primary particle size of 50 nm or more can be uniformly dispersed and added to the surface of the toner particle, thus making it possible to ensure fluidity for the toner and to quicken rising of the toner charge. Accordingly, it is possible to stabilize image quality of a formed image.

Further, in the invention, it is preferable that a thickness of the resin coating layer is in a range of 0.15 μm or more and 0.60 μm or less.

According to the invention, a thickness of the resin coating layer is in a range of 0.15 μm or more and 0.60 μm or less. When the thickness of the resin coating layer is less than 0.15 μm, a volume resistance value of the resin coated carrier becomes so low that there is a concern that the charge amount of the toner is lowered. In addition, carrier attachment to an image carrier easily occurs. When the thickness of the resin coating layer exceeds 0.60 μm, a volume resistance value of the resin coated carrier becomes so high that there is a concern that the charge amount of the toner is lowered. When the thickness of the resin coating layer is 0.15 μm or more and 0.60 μm or less, it is possible to charge the toner more stably over a long term without causing carrier attachment.

Further, in the invention, it is preferable that the resin coating layer includes a silicone resin or an acryl-modified silicone resin.

According to the invention, the resin coating layer includes a silicone resin or an acryl-modified silicone resin. It is thereby possible to improve releasing property of the toner against the carrier in development, thus making it possible to enhance developing property. It is also possible that the resin coating layer has a desirable hardness and further adhesiveness to the carrier core is enhanced, thus making it possible to exert an effect of stably charging the toner over a long term remarkably.

Further, in the invention, it is preferable that the resin coating layer includes a cross-linked silicone resin.

According to the invention, the resin coating layer includes a cross-linked silicone resin. It is thereby possible to further improve releasing property of the toner against the carrier in development, thus making it possible to further enhance developing property. Since it is also possible that the resin coating layer has a desirable hardness and further adhesiveness to the carrier core is further enhanced, thus making it possible to exert an effect of stably charging the toner over a long term more remarkably.

Further, in the invention, it is preferable that a ratio of a saturated charge amount of the resin coated carrier and the toner to a saturated charge amount of the carrier core and the toner is in a range of 0.6 or more and 1.1 or less.

According to the invention, a ratio of a saturated charge amount of the resin coated carrier and the toner to a saturated charge amount of the carrier core and the toner is in a range of 0.6 or more and 1.1 or less. When the resin coating layer has a ratio of a saturated charge amount of the resin coated carrier and the toner to a saturated charge amount of the carrier core and the toner in a range of 0.6 or more and 1.1 or less, it is possible to suppress a variation in the charge applying capability of the carrier, even when the resin coating layer on the surface of the carrier is scraped to reduce a coating area of the resin coating layer with the carrier core during long-term use. Accordingly, it is possible to charge the toner much more stably over a long term.

Further, in the invention, it is preferable that the resin coating layer further includes conductive particles.

According to the invention, the resin coating layer further includes conductive particles. It is thereby possible to relax a rise in the charge amount of the toner during image formation up to 2000 sheets from the beginning immediately after a new two-component developer is set in an image forming apparatus. Accordingly, it is possible to prevent that the charge amount of the toner is undesirably increased immediately after the new two-component developer is set in the image forming apparatus, thus making it possible to charge the toner much more stably over a long term.

Further, in the invention, it is preferable that a volume average particle size of the resin coated carrier is in a range of 35 μm or more and 55 μm or less.

According to the invention, a volume average particle size of the resin coated carrier is in a range of 35 μm or more and 55 μm or less. By using the resin coated carrier having a volume average particle size of 35 μm or more and 55 μm or less together with the toner, the transportation of the toner by the resin coated carrier in development is stabilized and formation of a high-resolution image is possible.

Further, the invention provides a two-component developer comprising the resin coated carrier mentioned above and a toner to which an external additive having an average primary particle size of 50 nm or more is added.

According to the invention, the two-component developer includes the carrier of the invention and a toner to which an external additive having an average primary particle size of 50 nm or more is added. Since the carrier of the invention is capable of stabilizing the charge amount of the toner over a long term even when being used with the toner to which an external additive having a large particle size is added, it is possible to form a high-quality image having little image defect such as fog stably.

Further, the invention provides a developing device that develops an electrostatic latent image formed on an image bearing member to form a visible image using the two-component developer mentioned above.

According to the invention, a developing device develops an electrostatic latent image formed on an image bearing member to form a visible image using the two-component developer of the invention. Since the two-component developer of the invention is capable of stabilizing the charge amount of the toner during long-term use, by using the two-component developer of the invention, it is possible to realize a developing device capable of stably forming an excellent toner image without fog over a long term.

Further, the invention provides an image forming apparatus comprising:

an image bearing member on which an electrostatic latent image is to be formed;

a latent image forming section for forming the electrostatic latent image on the image bearing member; and the developing device mentioned above.

According to the invention, as described above, an image forming apparatus is realized by including the developing device of the invention capable of forming a toner image without fog on the image bearing member. By forming an image by such an image forming apparatus, it is possible to stably form a high-quality image without fog for a long term.

BRIEF DESCRIPTION OF DRAWINGS

Other and further objects, features, and advantages of the invention will be more explicit from the following detailed description taken with reference to the drawings wherein.

DETAILED DESCRIPTION

Figure 1:
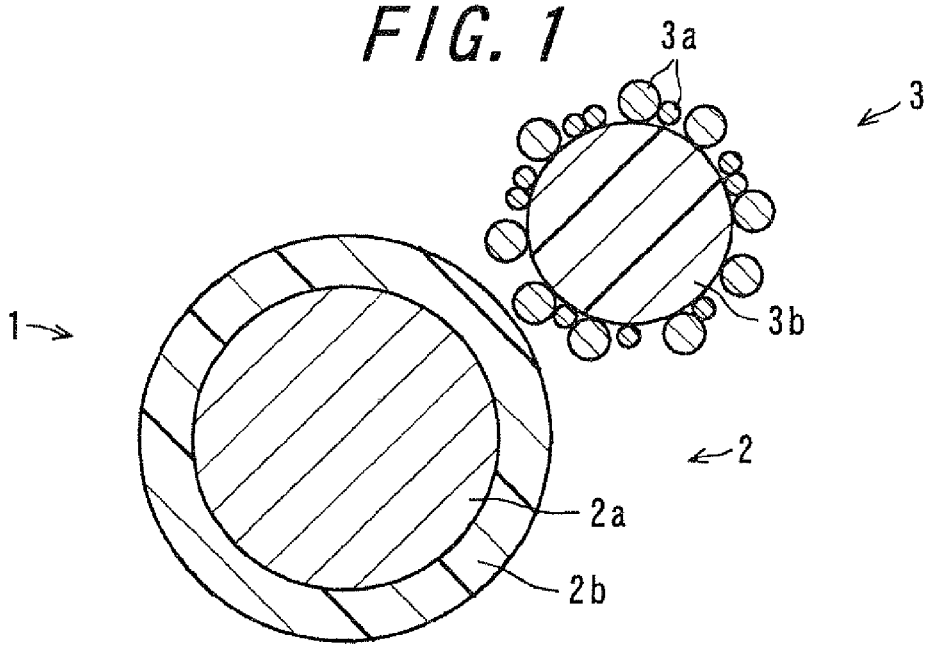
FIG. 1 is a cross-sectional view schematically showing a structure of a two-component developer including a resin coated carrier according to a first embodiment of the invention.

Now referring to the drawings, preferred embodiments of the invention are described below.

1. Resin Coated Carrier

A resin coated carrier according to a first embodiment of the invention is used with a toner in which an external additive having an average primary particle size of 50 nm or more is added to a toner particle, and has a carrier core and a resin coating layer on the surface of the carrier core. In the resin coated carrier, the following expression (1) is satisfied:

$$0.5 \leq -\log\{(A/C)/(B/C)\} \leq 2.5 \quad (1)$$

wherein A represents a volume resistance value (Ω/cm) of the resin coated carrier in an electric field of 1000 V/cm that is obtained by conducting a stirring test, B represents a volume resistance value (Ω/cm) of the resin coated carrier in an electric field of 1000 V/cm before the stirring test, and C represents a volume resistance value (Ω/cm) of the carrier core in an electric field of 1000 V/cm.

FIG. 1 is a cross-sectional view schematically showing a structure of a two-component developer 1 including a resin coated carrier 2 according to this embodiment. The two-component developer 1 includes the resin coated carrier 2 and a toner 3 in which an external additive 3*a* having an average primary particle size of 50 nm or more is added to a toner particle 3*b*. The resin coated carrier 2 includes a carrier core 2*a* and a resin coating layer 2*b*. The toner 3 includes the toner particle 3*b* and the external additive 3*a*. The entire carrier and the entire toner are hereinafter indicated, unless followed by the word "particle".

(1) Carrier Core

As the carrier core, the one commonly used in the art is usable, including, for example, a magnetic metal such as iron, copper, nickel and cobalt, and a magnetic metal oxide such as a ferrite and a magnetite. When the carrier is formed from a magnetic substance described above, it is possible to obtain a carrier suitable for a developer used in a magnetic brush development method. Among them, a ferrite is preferably used since the ferrite is capable of realizing a resin coated carrier which is excellent in charging performance and durability and has proper saturation magnetization.

The volume resistance value of the carrier core in an electric field of 1000 V/cm preferably falls in a range of $1.0\times10^7$ Ω/cm or more and $1.0\times10^9$ Ω/cm or less. When the volume resistance of the carrier core in an electric field of 1000 V/cm is in such a range, it is possible to obtain a development electrode effect and to form a high-density image. When the volume resistance value of the carrier core in an electric field of 1000 V/cm is less than $1.0\times10^7$ Ω/cm, it is not preferable because the volume resistance value of the resin coated carrier remarkably decreases and carrier attachment significantly increases in a case where scraping of the resin coating layer proceeds. When the volume resistance value of the carrier core in an electric field of 1000 V/cm exceeds $1.0\times10^9$ Ω/cm, it is not preferable because the development electrode effect is reduced and the image density decreases. The development electrode effect refers to an effect that the carrier serves as an electrode between a developer bearing member and a photoreceptor so that a Coulomb force received from an electric field is easily transmitted to the toner. When the toner receives the Coulomb force, the carrier with a lower volume resistance value produces greater development electrode effect.

Figure 2:
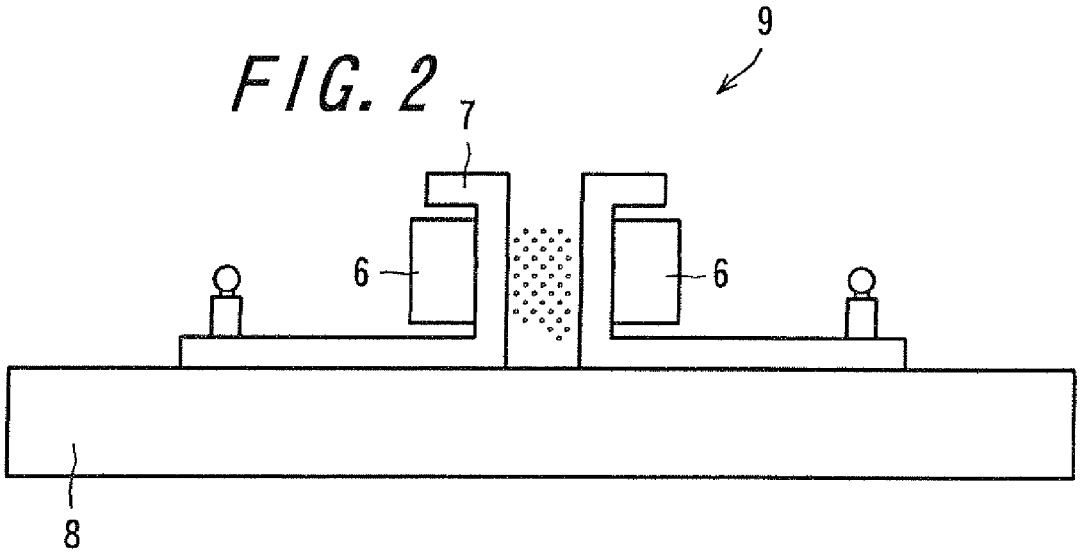
FIG. 2 is a schematic view schematically showing a structure a measurement jig.

The volume resistance value of the carrier core in an electric field of 1000 V/cm is measured with a measurement jig 9 as shown in FIG. 2. FIG. 2 is a schematic view schematically showing a structure of the measurement jig 9. The measurement jig 9 is constituted by a magnet 6, electrodes 7 made of aluminum, and a board (an acrylic resin board) 8. The electrodes 7 have an interval of 1 mm therebetween and form paralleled-plate electrodes having a size of 10 mm×40 mm. Between the electrodes, 200 mg of the carrier core is inserted, and subsequently the magnets 6 (with a surface magnetic flux density of 1500 gauss, and a magnet area of 10 mm×30 mm in a facing part) are disposed with the N pole faced to the S pole to hold the carrier core between the electrodes. A DC voltage that is stepped by 1 V up to 800 V is applied to the electrodes 7 to measure a current value thereof and calculate a bridge resistance value, and the value of which is defined as the volume resistance value of the carrier core. The volume resistance value of the resin coated carrier in an electric field of 1000 V/cm, which will be described below, is also a value calculated in the same manner by using the same measurement jig 9.

The volume average particle size of the carrier core is preferably 35 to 55 μm. When the volume average particle size of the carrier core is in such a range, it is possible to stabilize the toner transportation and form a high-definition image. When the volume average particle size of the carrier core is less than 35 μm, the resin coated carrier easily has a small volume average particle size and the resin coated carrier having a small volume average particle size causes an increase in carrier attachment, which is therefore not preferable. When the volume average particle size of the carrier core exceeds 55 μm, the resin coated carrier easily has a large volume average particle size and the resin coated carrier having a large volume average particle size is poor in granularity to deteriorate image quality, which is therefore not preferable.

The volume average particle size of the carrier core is a value measured with a laser diffraction/scattering type grain size measuring device (for example, MICROTRAC MT 3000 manufactured by NIKKISO Co., Ltd.).

The saturated charge amount of the carrier core and the toner to which an external additive having an average primary particle size of 50 nm or more is added, preferably falls in a range of 20 μC/g or more and 40 μC/g or less in absolute value. When the saturated charge amount (absolute value) of the carrier core and the toner is in such a range, a high-density image without fog can be formed even when scraping of the resin coating layer of the carrier proceeds due to long-term use. In a case where the saturated charge amount (absolute value) of the carrier core and the toner is less than 20 μC/g, a low-charged toner increases in a developer to increase toner scattering when scraping of the resin coating layer of the carrier proceeds due to long-term use. In a case where the saturated charge amount (absolute value) of the carrier core and the toner exceeds 40 μC/g, a high-charged toner increases in a developer to decrease the image density when scraping of the resin coating layer of the carrier proceeds due to long-term use.

The saturated charge amount of the carrier core and the toner is a charge amount obtained by mixing and stirring the carrier core and the toner in such a weight ratio that a ratio of an entire projection area of the toner (total of the projection areas of all toner particles) to an entire surface areas of the carrier core (total of the surface areas of all carrier cores) ((the entire projection area of toner/the entire surface area of carrier core)×100) (hereinafter referred to as "coverage $\theta_1$") is a specific value, and subsequently measuring a resultant with a suction type charge amount measuring device (for example, 210H-2A Q/M Meter manufactured by TREK INC.).

(2) Resin Coating Layer

Although a resin included in the resin coating layer is not particularly limited and any known one is usable, it is preferable that a silicone resin or an acryl-modified silicone resin is included. This makes it possible to improve releasing property of the toner against the carrier in development, thus developing property can be enhanced. Since it is also possible that the resin coating layer has a desirable hardness and further adhesiveness to the carrier core is enhanced, it is possible to exert an effect of stably charging the toner over a long term remarkably.

Among the resins described above, a cross-linked silicone resin is more preferable. By including the cross-linked silicone resin, releasing property of the toner against the carrier in development can be further improved, thus making it possible to further enhance developing property. Since it is also possible that the resin coating layer has a desirable hardness and further adhesiveness to the carrier core is further enhanced, it is possible to exert an effect of stably charging the toner over a long term more remarkably.

The cross-linked silicone resin is a known silicone resin in which hydroxyl groups bonded to a Si atom or a hydroxyl group and a —OX group bonded to a Si atom are cross-linked with each other and cured by a thermal dehydration reaction, a room temperature curing reaction and the like, as shown in the following chemical formula.

[Thermal Dehydration Reaction]

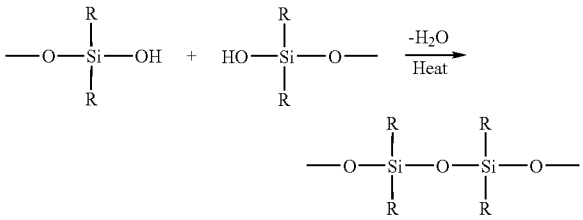

[Room Temperature Curing Reaction]

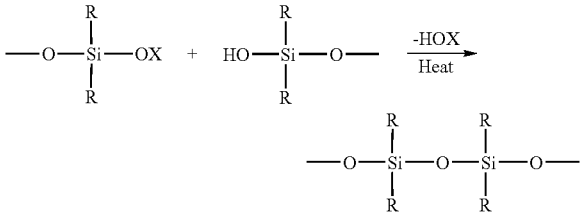

(wherein, a plurality of "R"s represent the same or different monovalent organic groups, and —OX group represents an acetoxy group, an aminoxy group, an alkoxy group, and an oxime group, etc.)

It is not particularly restricted as the cross-linked silicone resin, both of thermosetting silicone resin and cold setting silicone resin are usable. In order to cross-link the thermosetting silicone resin, it is necessary to heat the resin up to a temperature around 200° C. to 250° C. In order to cure the cold setting silicone resin, although it is not necessary to heat the resin, the resin is preferably heated up to a temperature around 150° C. to 280° C. for the purpose of shortening a length of time required for curing.

Among the cross-linked silicone resin, preferable is the silicone resin of which monovalent organic group represented by R is a methyl group. Since the cross-linked silicone resin containing a methyl group represented by R has a dense cross-linked structure, the use of the cross-linked silicone resin in forming the resin-coating layer on the carrier core material will result in a carrier which is favorable in water-shedding property, moisture resistance, and the like property. However, too dense a cross-linked structure tends to decrease the strength of the resin-coating layer. It is therefore important to select a molecular weight of the cross-linked silicone resin.

Further, a weight ratio (Si/C) between silicon and carbon in the cross-linked silicone resin is preferably 0.3 to 2.2. when the weight ratio (Si/C) is less than 0.3, hardness of the resin-coating layer is decreased and thus there is a concern that a length of life of the carrier 2 is shortened. On the other hand, when the weight ratio (Si/C) exceeds 2.2, the charge-imparting property of the carrier to the toner becomes more susceptible to a temperature change and thus there is a concern that the strength of the resin-coating layer is decreased.

It is possible to use a commercially-available cross-linked silicone resin including, for example: SR2400, SR2410, SR2411, SR2510, SR2405, 840RESIN, and 804RESIN, all of which are trade names and manufactured by Dow Corning Toray Co., Ltd.; and KR271, KR272, KR274, KR216, KR280, KR282, KR261, KR260, KR255, KR266, KR251, KR155, KR152, KR214, KR220, X-4040-171, KR201, KR5202, KR3093, KR240, KR350, KR400 (all of which are trade names and manufactured by Shin-Etsu Chemical Co., Ltd). The cross-linked silicon resins may be used each alone, and two or more of them may be used in combination.

(Method for Forming Resin Coating Layer)

The resin coating layer can be formed by coating the surface of the carrier core with a resin composition. The resin composition can be manufacture by mixing a predetermined amount of the cross-linked silicone resin, and as necessary, an appropriate amount of one or more of additives selected from conductive particles, an amino group-containing silane coupling agent, resins other than the silicone resin, bifunctional silicone oils and the like.

One example of form of the silicone resin composition is a form of solution in which the components stated above are dissolved in an organic solvent. As the organic solvent, any organic solvent can be used without particular limitation as long as the silicone resin can be dissolved in the organic solvent. Examples of the organic solvent include: aromatic hydrocarbons such as toluene and xylene; ketones such as acetone and methyl ethyl ketone; ethers such as tetrahydrofuran and dioxane; higher alcohols; and a mixed solvent of two or more of the substances just cited. The use of the silicone resin compound for coating in the solvent form (hereinafter referred to as "coat-resin liquid") allows the resin-coating layer to be easily formed on the surface of core material of the carrier.

For example, the carrier is manufactured in a manner that the coat-resin liquid is applied to the surface of core material of the carrier to thereby form a coating layer and the coating layer is then heated to remove the organic solvent through volatilization and further cured under heat or merely cured during or after drying, thus resulting in the resin-coating layer.

As a method of applying the coat-resin liquid to the surface of core material of the carrier, it is possible to employ, for example, a dipping method for impregnating the core material of the carrier with the coat-resin liquid; a spraying method for spraying the core material of the carrier with the coat-resin liquid; a fluid bed process for spraying the coat-resin liquid to the core material of the carrier which is suspended in fluidizing air; and the like method. Among the methods just cited, preferred is the dipping method in which a coating can be easily formed.

For drying the coating layer, a drying accelerator can be used. As the drying accelerator, it is possible to use heretofore known ingredients including metal soap formed of, for example, salts of lead, iron, cobalt, manganese, and zinc of naphthyl acid, octylic acid, etc.; and organic amines such as ethanolamine.

Here, to conduct coating of the resin composition suitably, it is necessary to take a balance of both deposition of the resin caused by the solvent evaporation, and curing of the cross-linked silicone resin and incorporating of the additive into the resin. They vary greatly depending on heating temperature, a pressure reduction amount and the like, for which a certain amount of time is required.

Thus, a curing accelerator may be used for drying a coating layer (coat-resin liquid). In such a case, an organic compound catalyst that has a high capability as a curing accelerator for the cross-linked silicone resin, such as a Sn compound, an Al compound and a Ti compound, is preferable. Such a curing catalyst functions to accelerate curing of the cross-linked silicone resin. 0.2 to 5 parts by weight of the curing catalyst is preferably included in 100 parts by weight of the resin of the resin coating layer.

The coating layer is cured at a heating temperature selected according to the type of the silicone resin. For example, a preferable heating temperature is around 150° C. to 280° C. As a matter of course, no heating is required in the case where the silicone resin in use is the cold setting silicone resin. In this case, however, there may be heating up to around 150° C. to 280° C. for the purpose of enhancing the mechanical strength of the to-be-formed resin-coating layer, shortening the length of time for curing, and the like effect.

(Conductive Particles)

The resin composition preferably includes conductive particles. By including the conductive particles in the resin coating layer, it is possible to relax a rise in the charge amount of the toner during image formation, for example, up to 2000 sheets from the beginning immediately after a new two-component developer is set in an image forming apparatus. Accordingly, it is possible to prevent that the charge amount of the toner is undesirably increased immediately after the new two-component developer is set in the image forming apparatus, thus making it possible to charge the toner much more stably over a long term.

As the conductive particles, for example, a conductive carbon black, or an oxide such as a conductive titanic oxide or a tin oxide is used. To exhibit conductivity with a small amount of addition, a carbon black or the like is preferable, but there is a concern that carbon is separated from the resin coating layer of the carrier when used with a color toner. A conductive titanic oxide that is doped with antimony or the like may be used in such a case.

The conductive particles may be used each alone or two or more of them may be used in combination. Although the volume average particle size of the conductive particles is not particularly limited, it is preferably 0.02 to 2 μm, and more preferably, 0.02 to 1 μm. Note that, the volume average particle size is a value measured with a laser diffraction/scattering type grain size measuring device (for example, LA-920 manufactured by HORIBA Ltd.).

Although the amount of conductive particles to be included in the resin coating layer is not particularly limited, it is preferably 30 or less parts by weight based on 100 parts by weight of the cross-linked silicone resin, and more preferably, 1 part by weight or more and 30 parts by weight or less. When the amount of the conductive particles to be included exceeds 30 parts by weight based on 100 parts by weight of the cross-linked silicone resin, the conductive particles easily fall off the resin coating layer, and it is concerned that a color image is affected. Further, there is a concern that mechanical strength of the resin coating layer and adhesiveness to the carrier core become insufficient and the resin coating layer is separated to expose the carrier core. When the resin coating layer is separated to expose the carrier core, there is a concern that charging performance is changed compared to that of the resin coated carrier in an initial stage and stable charging of the toner is inhibited.

When the amount of the conductive particles to be included is 30 or less parts by weight based on 100 parts by weight of the cross-linked silicone resin, it is possible to prevent the conductive particles from falling off the resin coating layer and to suppress influence on a color image. Since it is also possible to improve the mechanical strength of the resin coating layer and the adhesiveness to the carrier core, a resin coating layer capable of stably charging the toner over a long period of time is realized. Accordingly, a developer capable of forming a high-quality image more stably is realized.

When the amount of the conductive particles to be included is less than 1 part by weight based on 100 parts by weight of the cross-linked silicone resin, an effect of adding the conductive particles is not obtained to cause a concern that it is impossible to apply sufficient charges to the toner. When the amount of the conductive particles to be included is 1 part by weight or more based on 100 parts by weight of the cross-linked silicone resin, an effect of adding the conductive particles is exerted more reliably so that sufficient charges can be applied to the toner.

The silicone resin composition may contain a silane coupling agent for more easier adjustment of a charge amount of the toner. Among the silane coupling agents, preferably used is a silane coupling agent which has an electron-releasing functional group, and more preferably used is an amino group-containing silane coupling agent. As the amino group-containing silane coupling agent, it is possible to use a heretofore known silane coupling agent, for example, indicated by the following general formula (2):

$$(Y)n\mathrm{Si}(R)m(Z)q \qquad (2)$$

wherein "m" pieces of "R"s and "q" pieces of "Z"s are the same or different and represent an alkyl group, an alkoxy group, or a chlorine atom; and "n" pieces of "Y"s are the same or different and represent a hydrocarbon group containing an amino group, where "m" and "n" each represent an integer of 1 to 3 so as to satisfy the relation: m+n=4.

In the above general formula (2), examples of the alkyl group represented by R and Z include linear or branched alkyl groups having a carbon number of 1 to 4, such as a methyl group, an ethyl group, a propyl group, an isopropyl group, a butyl group, an isobutyl group, and a tert-butyl group, among which the methyl group and the ethyl group are preferred. Examples of the alkoxy group include linear or branched alkoxy groups having a carbon number of 1 to 4, such as a methoxy group, an ethoxy group, a propoxy group, an isopropoxy group, a butoxy group, an isobutoxy group, and a tert-butoxy group, among which the methoxy group and the ethoxy group are preferred. Examples of the hydrocarbon group containing an amino group represented by Y include —$(CH_2)$a-X (wherein "X" represents an amino group, an aminocarbonylamino group, an aminoalkylamino group, a phenylamino group, or dialkylamino group, and "a" represents an integer of 1 to 4), and -Ph-X (wherein "X" is as described above, and "-Ph-" represents a phenylene group).

Specific examples of the amino group-containing silane coupling agent include the following substances:

$H_2N(H_2C)_3Si(OCH_3)_3$;

$H_2N(H_2C)_3Si(OC_2H_5)_3$;

$H_2N(H_2C)_3Si(CH_3)(OCH_3)_2$;

$H_2N(H_2C)_2HN(H_2C)_3Si(CH_3)(OCH_3)_2$;

$H_2NOCHN(H_2C)_3Si(OC_2H_5)_3$;

$H_2N(H_2C)_2HN(H_2C)_3Si(OCH_3)_3$;

$H_2N$-Ph-$Si(OCH_3)_3$ (wherein -Ph- represents a p-phenylene group);

Ph-$HN(H_2C)_3Si(OCH_3)_3$ (wherein Ph- represents a phenyl group); and $(H_9C_4)_2N(H_2C)_3Si(OCH_3)_3$.

The amino group-containing silane coupling agents may be used each alone, and two or more of the amino group-containing silane coupling agents may be used in combination. A usage of the amino group-containing silane coupling agent may be appropriately selected from such a range that sufficient charges are applied to the toner and that the mechanical strength, etc. of the resin-coating layer does not deteriorate. The usage of the amino group-containing silane coupling agent is preferably 10 parts by weight or less and more preferably 0.01 part by weight to 10 parts by weight, based on 100 parts by weight of silicone resin.

The silicone resin composition may contain other types of resin, together with the silicone resin, in such a range that favorable properties of the resin-coating layer formed of the silicone resin (especially, the cross-linked silicone resin) are not impaired. Examples of the other types of resin include epoxy resin, urethane resin, phenol resin, acrylic resin, styrene resin, polyamide, polyester, acetal resin, polycarbonate, vinyl chloride resin, vinyl acetate resin, cellulose resin, polyolefin, and copolymer resin and compounded resin of the resins just cited. Further, the silicone resin composition for coating may contain bifunctional silicone oil, in order to further enhance the moisture resistance, releasing property, and the like property of the resin-coating layer formed of the cross-linked silicone resin.

The total solid concentration of the coat-resin liquid is not particularly limited, but it is preferably adjusted such that a thickness of the cured resin coating layer is in a range of 0.15 μm or more and 0.60 μm or less in consideration of coating operability against the carrier core and the like. When the thickness of the resin coating layer is less than 0.15 μm, the volume resistance value of the carrier is so low as to cause a concern that the charge amount of the toner is reduced. In addition, carrier attachment to an image bearing member occurs easily. When the thickness of the resin coating layer exceeds 0.60 μm, the volume resistance value of the carrier is so high as to cause a concern that the charge amount of the toner is reduced. When the thickness of the resin coating layer is 0.15 μm or more and 0.60 μm or less, it is possible to charge the toner more stably without causing carrier attachment over a long term.

The thickness of the resin coating layer of the resin coated carrier is obtainable by pulverizing the resin coated carrier in a mortar and thereafter observing a cross section of the pulverized resin coated carrier with a scanning electron microscope.

Although the amount of the resin in the resin coating layer is not particularly limited, it is preferably in a range of 0.4 part by weight or more and 2.0 parts by weight or less based on 100 parts by weight of the carrier core when the silicone resin is used. When the amount of the resin in the resin coating layer is in such a range, it is possible to obtain a carrier that realizes a variation in the volume resistance value of the invention more easily. When the amount of the resin is less than 0.4 part by weight, it is not preferable because an exposed area of the carrier core becomes large to be easily affected by an environmental change, particularly in humidity. Further, when the amount of the resin exceeds 2.0 parts by weight, it is not preferable because the resin fails to uniformly coat the surface of the carrier core and the carriers aggregate with each other, causing deterioration of a carrier yield.

(3) Resin Coated Carrier

The volume resistance value of the resin coated carrier obtained as described above in an electric field of 1000 V/cm is preferably in a range of $1.0\times10^{11}$ Ω/cm or more and $1.0\times10^{14}$ Ω/cm or less. When the volume resistance value of the resin coated carrier in an electric field of 1000 V/cm is in such a range, it is possible to obtain a resin coated carrier that causes no carrier attachment and is excellent in rising property of toner charging. When the volume resistance value of the resin coated carrier in an electric field of 1000 V/cm is less than $1.0\times10^{11}$ Ω/cm, carrier attachment is increased. When the volume resistance value of the resin coated carrier in an electric field of 1000 V/cm exceeds $1.0\times10^{14}$ Ω/cm, rising of charging is delayed.

A method for measuring the volume resistance value of the resin coated carrier in an electric field of 1000 V/cm is the same as the method for measuring the volume resistance value of the carrier core described above.

In this embodiment, in a resin coated carrier that is used with a toner to which an external additive having an average primary particle size of 50 nm or more is added, and that has a carrier core and a resin coating layer on the surface of the carrier core, the following expression (1) is satisfied:

$$0.5 \le -\log\{(A/C)/(B/C)\} \le 2.5 \quad (1)$$

wherein A represents a volume resistance value (Ω/cm) of the resin coated carrier in an electric field of 1000 V/cm that is obtained by conducting a stirring test, B represents a volume resistance value (Ω/cm) of the resin coated carrier in an electric field of 1000 V/cm before the stirring test, and C represents a volume resistance value (Ω/cm) of the carrier core in an electric field of 1000 V/cm.

By using the toner to which the external additive having an average primary particle size of 50 nm or more is added, it is possible to improve transfer efficiency, particularly in a color toner, compared to a case where a toner to which an external additive having an average primary particle size of less than 50 nm is added.

When $-\log\{(A/C)/(B/C)\}$ is less than 0.5, a variation in the volume resistance values of the resin coated carrier before and after the stirring test is too small to prevent reduction of the charge applying capability of the carrier against the toner over a long term. When $-\log\{(A/C)/(B/C)\}$ exceeds 2.5, a variation in the volume resistance values of the resin coated carrier before and after the stirring test is so great that carrier attachment to an image bearing member is increased. On the surface of the resin coated carrier to which the external additive having a large particle size, an average primary particle size of which is 50 nm or more, is added, the resin coating layer is properly scraped by stirring in a development tank to be renewed to a resin coating layer to which the external additive is not attached. Since the volume resistance values of the resin coated carrier and the carrier core satisfy the expression (1), reduction of the charge applying capability of the carrier can be suppressed even when the resin coating layer is scraped. Accordingly, it is possible to realize a carrier that is excellent in transfer efficiency and capable of stably charging the toner over a long term even with an increase in the number of print sheets.

The stirring test is a test in which a developer that is obtained by mixing the resin coated carrier core and the toner so that a ratio of an entire projection area of the toner (total of the projection areas of all toner particles) to an entire surface area of the carrier core (total of the surface areas of all carrier cores) ((the entire projection area of toner/the entire surface area of carrier core)×100) (hereinafter referred to as "coverage $\theta_2$") is 70% is placed in a glass bottle, and mixed and stirred by a mixer mill under conditions of 26.3 Hz for three hours.

A method for measuring the volume resistance rate of the resin coated carrier subjected to the stirring test is the same as the method for measuring the volume resistance value of the carrier core described above.

The saturated charge amount of the resin coated carrier and the toner to which the external additive having an average primary particle size of 50 nm or more is added, preferably falls in a range of 20 μC/g or more and 36 μC/g or less in absolute value. When the saturated charge amount (absolute value) of the resin coated carrier and the toner is in such a range, a high-density image without fog can be formed. When the saturated charge amount (absolute value) of the resin coated carrier and the toner is less than 20 μC/g, a low-charged toner increases in a developer to increase toner scattering. When the saturated charge amount (absolute value) of the resin coated carrier and the toner exceeds 36 μC/g, a high-charged toner increases in a developer to decrease the image density.

The saturated charge amount of the resin coated carrier and the toner is a value obtained by mixing and stirring the resin coated carrier and the toner in such a weight ratio that the coverage $\theta_2$ is a specific value, and subsequently measuring with a suction type charge amount measuring device (for example, 210H-2A Q/M Meter of TREK INC.).

A ratio of the saturated charge amount of the resin coated carrier and the toner to the saturated charge amount of the carrier core and the toner is preferably in a range of 0.6 or more and 1.1 or less. When the ratio of the saturated charge amount of the resin coated carrier and the toner to the saturated charge amount of the carrier core and the toner is less than 0.6 or exceeds 1.1, it is inhibited to stabilize the charge amount of the toner when scraping of the resin coating layer of the resin coated carrier proceeds due to long-term use. When the resin coating layer has the ratio of the saturated charge amount of the resin coated carrier and the toner to the saturated charge amount of the carrier core and the toner in a range of 0.6 or more and 1.1 or less, it is possible to suppress reduction of the charge applying capability of the carrier even when the resin coating layer on the surface of the carrier is scraped so that a coating area of the resin coating layer is reduced. Accordingly, it is possible to charge the toner much more stably over a long term.

The volume average particle size of the resin coated carrier is preferably 35 μm or more and 55 μm or less. By using the resin coated carrier having the volume average particle size of 35 μm or more and 55 μm or less with the toner, toner transportation by the resin coated carrier in a developing process is stabilized and a high-definition image can be formed.

Although the resin coated carrier preferably has a spherical shape, the effect of the invention is not lost even in a non-spherical shape.

(4) Toner

The toner is formed with an external additive having an average primary particle size of 50 nm or more added to a toner particle. Materials of the toner particle include a binder resin, a colorant, a release agent, a charge control agent and the like.

(Binder Resin)

The binder resin is not particularly restricted, and a known binder resin for black toner or color toner is usable. Examples thereof include a polyester resin, a styrene resin such as polystyrene and a styrene-acrylic acid ester copolymer resin, an acrylic resin such as a polymethylmethacrylate, a polyolefin resin such as a polyethylene, a polyurethane, and an epoxy resin. In addition, a resin obtained by polymerization reaction by mixture of a monomer mixture material and a release agent may be used. The binder resins may be used each alone, or two or more of them may be used in combination.

In a case of using the polyester resin as the binder resin, examples of the aromatic alcohol ingredient required for obtaining the polyester resin include bisphenol A, polyoxyethylene-(2.2)-2,2-bis(4-hydroxyphenyl) propane, polyoxyethylene-(2.0)-2,2-bis(4-hydroxypheny) propane, polyoxypropylene-(2.0)-2,2-bis(4-hydroxypheny) propane, polyoxypropylene-(2.2)-polyoxyethylene-(2.0),-2,2-bis(4-hydroxypheny) propane, polyoxypropylene-(6)-2,2-bis(4-hydroxypheny) propane, polyoxypropylene-(2.2)-2,2-bis(4-hydroxypheny) propane, polyoxypropylene-(2.4)-2,2-bis(4-hydroxypheny) propane, polyoxypropylene-(3.3)-2,2-bis(4-hydroxypheny) propane, and derivatives thereof.

Further, examples of the polybasic acid ingredient in the polyester resin include dibasic acids such as succinic acid, adipic acid, sebasic acid, azelaic acid, dodecenyl succinic acid, n-dodecyl succinic acid, malonic acid, maleic acid, fumaric acid, citraconic acid, itaconic acid, glutaconic acid, cyclohexane dicarboxylic acid, ortho-phthalic acid, isophthalic acid, and terephthalic acid, tri- or higher basic acids such as trimellitic acid, trimethinic acid, and pyromellitic acid, as well as anhydrides and lower alkyl esters thereof. With a view point of heat resistant cohesion, terephthalic acid or lower alkyl esters thereof are preferred.

Here, an acid value of the polyester resin is preferably 5 to 30 mg KOH/g. When the acid value is less than 5 mg KOH/g, charging property of the resin is caused to decrease or the charge control agent is less likely to disperse in the polyester resin. This causes a concern that rising of the charge amount and stability of the charge amount at the time of repetitive developments in continuous use are negatively affected. When the acid value exceeds 30 mg KOH/g, there is a concern that hygroscopic property is improved by a functional group due to the acid value, causing a variation in the charge amount due to a change in usage environments, for example, a decrease in the charge amount in high-temperature and high-humidity environment. As a result, the above range is preferable. Note that, the acid value is measured in accordance with a potentiometric titration method described in Japanese Industrial Standards (JIS) K0070-1992.

A glass transition temperature (Tg) of the binder resin is not particularly limited and can be appropriately selected from a broad range, but in consideration of fixing property and storage stability of an obtained toner, 40° C. or more and 80° C. or less is preferable. When the glass transition temperature is less than 30° C., heat aggregation of toners easily occurs inside the image preparing apparatus due to insufficient storage stability, which may cause development failure. Further, a temperature at which high-temperature offset phenomenon begins to occur (hereinafter, referred to as "high-temperature offset-starting temperature") is lowered. The "high-temperature offset phenomenon" refers to a phenomenon in which, when a toner is heated and pressurized by a fixing member such as a heating roller so as to be fixed onto a recording medium, the overheating of the toner causes that an aggregation force of toner particles becomes lower than an adhesive force between the toner and the fixing member, so that a toner layer is segmented and the toner is partially removed by adherence to the fixing member. When the glass transition temperature exceeds 80° C., there is a concern that fixing failure occurs due to deterioration of fixing property.

A softening temperature ($T_{1/2}$) of the binder resin is not particularly limited and can be appropriately selected from a broad range, but it is preferably 120° C. or less, and more preferably 60° C. or more and 120° C. or less. When the softening temperature is less than 60° C., storage stability of the toner deteriorates and the heat aggregation of toners easily occurs inside the image preparing apparatus, which inhibits stable feeding of the toner to an image bearing member to cause a concern that development failure occurs. There is also a concern that a breakdown of the image preparing apparatus occurs. When the softening temperature exceeds 120° C., the toner is less easily fused or softened in fixing the toner onto a recording medium, thus causing a concern that fixing failure occurs due to deterioration of fixing property of the toner onto the recording medium.

A molecular weight of the binder resin is not particularly limited and can be appropriately selected from a broad range, but it is preferably 5,000 or more and 500,000 or less in a weight-average molecular weight (Mw). When the weight-average molecular weight is less than 5,000, mechanical strength of the binder resin is decreased and the obtained toner particles are easily pulverized by stirring or the like inside a developing device to change a shape of the toner particles, thus causing a concern that, for example, charging performance thereof have variations. When the weight-average molecular weight exceeds 500,000, the binder resin is less likely to be fused to deteriorate the fixing property of the toner, thus causing a concern that fixing failure occurs. Here, the weight-average molecular weight of the binder resin is a value in polystyrene equivalent, which is measured by a gel permeation chromatography (abbreviated as a GPC).

(Colorant)

As a colorant, various kinds of colorants are usable in accordance with a desired color; for example, a yellow toner colorant, a magenta toner colorant, a cyan toner colorant, a black toner colorant and the like.

As a yellow toner colorant, examples thereof include, in reference to the color index classification, an organic pigment such as C. I. Pigment Yellow 1, C. I. Pigment Yellow 5, C. I. Pigment Yellow 12, C. I. Pigment Yellow 15 and C. I. Pigment Yellow 17, C. I. Pigment Yellow 74, C. I. Pigment Yellow 93, C. I. Pigment Yellow 180 or C. I. Pigment Yellow 185; an inorganic pigment such as a yellow iron oxide or an ocher; a nitro dye such as C. I. Acid Yellow 1; and an oil soluble dye such as C. I. Solvent Yellow 2, C. I. Solvent Yellow 6, C. I. Solvent Yellow 14, C. I. Solvent Yellow 15, C. I. Solvent Yellow 19 or C. I. Solvent Yellow 21.

As a magenta toner colorant, examples thereof include, in reference to the color index classification, C. I. Pigment Red 49, C. I. Pigment Red 57, C. I. Pigment Red 81, C. I. Pigment Red 122, C. I. Solvent Red 19, C. I. Solvent Red 49, C. I. Solvent Red 52, C. I. Basic Red 10 and C. I. Disperse Red 15.

As a cyan toner colorant, examples thereof include, in reference to the color index classification, C. I. Pigment Blue 15, C. I. Pigment Blue 16, C. I. Solvent Blue 55, C. I. Solvent Blue 70, C. I. Direct Blue 25 and C. I. Direct Blue 86.

As a black toner colorant, examples thereof include carbon blacks such as channel black, roller black, disk black, gas furnace black, oil furnace black, thermal black, and acetylene black. The carbon black may be selected properly from among various kinds of carbon blacks mentioned above according to a target design characteristic of toner.

In addition to these pigments, a bright red pigment, a green pigment and the like are also usable as a colorant. The colorants may be used each alone, or two or more of them may be used in combination. Further, two or more of the similar color series are usable, or one of or two or more of the different color series are also usable.

The colorant may be used in the form of a masterbatch. The masterbatch of the colorant can be produced in the same manner as a general masterbatch. For example, a melted synthetic resin and a colorant are kneaded so that the colorant is uniformly dispersed in the synthetic resin, then the resultant mixture thus melt-kneaded is granulated to produce a masterbatch. For the synthetic resin, the same kind as the binder resin of the toner, or a synthetic resin having excellent compatibility with the binder resin of the toner is used. At this time, a ratio of the synthetic resin and the colorant to be used is not particularly restricted, but preferably 30 to 100 parts by weight based on 100 parts by weight of the synthetic resin. Further, the masterbatch is granulated so as to have a particle size of about 2 to 3 mm.

Further, the amount of a colorant to be used is not particularly restricted, but preferably 5 to 20 parts by weight based on 100 parts by weight of the binder resin. This amount does not refer to the amount of the masterbatch, but to the amount of the colorant itself included in the masterbatch. By using a colorant within such a range, it is possible to form a high-density and extremely high-quality image without damaging various physical properties of the toner.

(Release Agent)

The release agent is added to provide a toner with releasing property in fixing the toner onto a recording medium. Therefore, it is possible to increase the high-temperature offset-starting temperature and to improve the anti-high temperature offset property compared to the case where the release agent is not used. In addition, it is possible to fuse the release agent by the heat in fixing the toner, lower the fixing-starting temperature, and improve the anti-hot offset property. For the release agent, the one commonly used in the art is usable, including, for example, a petroleum wax such as a paraffin wax, a derivative thereof, a microcrystalline wax and a derivative thereof, a hydrocarbon synthetic wax such as a Fischer-Tropsch wax, a derivative thereof, a polyolefin wax, a derivative thereof, a low-molecular-weight polypropylene wax, a derivative thereof, a polyolefin polymer wax (for example, a low-molecular-weight polyethylene wax) and a derivative thereof, a botanical wax such as a carnauba wax, a derivative thereof, a rice wax, a derivative thereof, a candelilla wax, a derivative thereof and a Japan wax, an animal wax such as a beeswax and a spermaceti wax, a synthetic wax of fat and oil such as a fatty acid amide and a phenol fatty acid ester, a long-chain carboxylic acid, a derivative thereof, a long-chain alcohol, a derivative thereof, a silicone polymer and a higher fatty acid. Note that, examples of the above derivatives include an oxide, a vinyl monomer-wax block copolymer, and a vinyl monomer-wax graft denatured material. Although the amount of the release agent to be used is not particularly limited and can be appropriately selected from a broad range, it is preferably 0.2 to 20 parts by weight based on 100 parts by weight of the binder resin.

(Charge Control Agent)

The charge control agent is added for the purpose of controlling a friction charging property of the toner. As the charge control agent, the one commonly used in the art for controlling a negative charge is usable. Examples of the charge control agent for controlling a negative charge include an oil-soluble dye such as an oil black or a spilon black, a metal-containing azo compound, an azo complex dye, a metal salt of naphthene acid, a metal complex or metal salt (where the metal is a chrome, a zinc, a zirconium or the like) of a salicylic acid or of a derivative thereof, a boron compound, a fatty acid soap, a long-chain alkylcarboxylic acid salt and a resin acid soap. Among them, a boron compound, which does not contain heavy metal, is particularly preferable. The charge control agent may be selectively used depending on use. The charge control agents may be used each alone, or as necessary, two or more of them may be used in combination. The amount of the charge control agent to be used is not particularly limited and can be appropriately selected from a broad range, but it is preferably 0.5 to 3 parts by weight based on 100 parts by weight of the binder resin.

(Method for Manufacturing Toner)

A method for manufacturing toner particles is not particularly limited, and the toner particles are obtainable by any known manufacturing method.

The toner particles can be manufactured by, for example, a melt-kneading pulverization method. The melt-kneading pulverization method includes, for example, a mixing step, a melt-kneading step, a pulverizing step, and a classifying step. According to the melt-kneading pulverization method, at the mixing step, a binder resin, a colorant, a release agent, a charge control agent and other additives are dry-mixed together in predetermined amounts to obtain a mixture. At the melt-kneading step, the obtained mixture is melt-kneaded, and the obtained melt-kneaded product is cooled and solidified to obtain a solidified product. At the pulverizing step, the solidified product is mechanically pulverized. At the classifying step, excessively pulverized toner particles and coarse toner particles are removed from the pulverized product obtained at the pulverizing step using a classifier. These steps make it possible to prepare the toner particles.

Examples of the mixer used for dry-mixing include Henschel type mixer such as HENSCHELMIXER (trade name, manufactured by Mitsui Mining Co., Ltd.), SUPERMIXER (trade name, manufactured by Kawata MFG Co., Ltd.) and MECHANOMIL (trade name, manufactured by Okada Seiko Co., Ltd.), ANGMIL (trade name, manufactured by Hosokawa Micron Corporation), HYBRIDIZATION SYSTEM (trade name, manufactured by Nara Machinery Co., Ltd.) and COSMOSYSTEM (trade name, manufactured by Kawasaki Heavy Industries, Ltd.).

The kneading is conducted with stirring while being heated at a temperature (usually, about 80 to about 200° C., preferably, about 100 to about 150° C.) higher than the melting temperature of the binder resin. As the kneader, a general kneader is usable, such as biaxial extruder, three-roll mill or a laboplast mill. Specific example thereof includes a monoaxial or biaxial extruder such as TEM-100B (trade name, manufactured by Toshiba Machine Co., Ltd.) or PCM-65/87 (trade name, manufactured by Ikegai, Ltd.), or the one of the open roll system such as KNEADEX (trade name, manufactured by Mitsui Mining Co., Ltd.). Among them, the one of the open roll system is preferred. The solidified product obtained by cooling the melt-kneaded product is pulverized by using a cutter mill, a Feather mill, a jet mill or the like. For example, the solidified product is coarsely pulverized by using the cutter mill and is then pulverized by the jet mill to obtain a toner having a desirable volume average particle size.

For the classification, a known classifier is usable that is capable of removing excessively pulverized toner particles and coarse toner particles through classification by a centrifugal force or wind force, and an example thereof includes a swivel pneumatic classifier (rotary pneumatic classifier).

Further, the toner particles can be manufactured by, for example, coarsely pulverizing the solidified product of the melt-kneaded product, forming an aqueous slurry of the obtained coarsely pulverized product, atomizing the obtained aqueous slurry by using a high-pressure homogenizer, and heating, aggregating and melting the obtained fine particles in an aqueous medium. The solidified product of the melt-kneaded product is coarsely pulverized by using, for example, the jet mill or the hand mill. Through the coarse pulverization, coarse particles having a particle size of about 100 μm to about 3 mm is obtained. The coarse particles are dispersed in water to prepare an aqueous slurry thereof. To disperse the coarse particles in water, for example, a dispersant such as sodium dodecylbenzenesulfonate is dissolved in a suitable amount in water to obtain an aqueous slurry in which the coarse particles are homogeneously dispersed. By treating the aqueous slurry using a high-pressure homogenizer, the coarse particles in the aqueous slurry are atomized so that an aqueous slurry including fine particles having a volume average particle size of about 0.4 to about 1.0 μm is obtained. The aqueous slurry is heated to aggregate fine particles which are then melt-bonded together to obtain a toner having a desirable volume average particle size and an average circularity degree. The volume average particle size and the average circularity degree can be set to desirable values by, for example, appropriately selecting the temperature for heating the aqueous slurry of fine particles and the time for heating. The heating temperature is appropriately selected from a temperature range which is not lower than the softening temperature of the binder resin and is lower than the thermal decomposition temperature of the binder resin. When the time for heating is the same, the volume average particle size of the toner increases as the heating temperature increases.

As the high-pressure homogenizer, one placed in the market has been know. Examples of the high-pressure homogenizer placed in the market include chamber-type high-pressure homogenizers such as MICROFLUIDIZER (trade name, manufactured by Microfluidics International Corporation), NANOMIZER (trade name, manufactured by Nanomizer Inc.) and ULTIMIZER (trade name, manufactured by Sugino Machine Limited), and HIGH-PRESSURE HOMOGENIZER (trade name, manufactured by Rannie Corporation), HIGH-PRESSURE HOMOGENIZER (trade name, manufactured by Sanmaru Machinery Co., Ltd.), HIGH-PRESSURE HOMOGENIZER (trade name, manufactured by Izumi Food Machinery Co., Ltd.) and NANO3000 (trade name, manufactured by Beryu Co., Ltd.).

The toner particles thus prepared may be subjected to the spheroidizing treatment, and examples of a spheroidizing device include a shock type spheroidizing device and a hot air type spheroidizing device. As the shock type spheroidizing device, the one placed in the market is also usable, such as FACULTY (trade name, manufactured by Hosokawa Micron Corporation) and HYBRIDIZATION SYSTEM (trade name, manufactured by Nara Machinery Co., Ltd.). As the hot air type spheroidizing device, the one placed in the market is also usable, such as a surface modifying machine, METEORAINBOW (trade name, manufactured by Nippon Pneumatic Mfg Co., Ltd.)

(External Additive)

To the toner particles thus obtained, an external additive having an average primary particle size of 50 nm or more, and preferably 0.1 μm or more, is added. This makes it possible to improve transfer property, particularly in a color toner. As the external additive, the one commonly used in the art is usable and examples thereof include a silicon oxide, a titanic oxide, a silicon carbide, an aluminum oxide and a barium titanate.

In addition to the examples above, at least one of external additives having an average primary particle size smaller than the external additive having an average primary particle size of 50 nm or more can be added in combination. The external additive usable in combination is not particularly limited and examples thereof include a silicon oxide, a titanic oxide, a silicon carbide, an aluminum oxide and a barium titanate. The average primary particle size of the external additives usable in combination is preferably 5 to 30 nm. By using the external additives having such a particle size in combination, toner fluidity can be improved. When the average primary particle size of the external additives usable in combination is less than 5 nm, uniform dispersion thereof is difficult. When the average primary particle size of the external additives usable in combination exceeds 30 nm, an effect of improving fluidity is insufficient.

It is possible to measure the average primary particle size of the external additive by using a particle size distribution-measuring device that utilizes dynamic scattering of light, such as DLS-800 (trade name, manufactured by Otsuka Electronics Co., Ltd.) and COULTER N4 (trade name, manufactured by Coulter Electronics Ltd.), however, since it is difficult to dissociate the secondary aggregation of particles subjected to the hydrophobic treatment, it is preferable to directly obtain the average primary particle size by analyzing the image photographed by using a scanning electron microscope (SEM) or a transmission electron microscope (TEM).

The amount of addition of the external additive is not particularly limited, but it is preferably 0.1 to 3.0 parts by weight based on 100 parts by weight of the toner particles.

When the amount of addition of the external additive is in such a range, it is possible to provide fluidity for the toner and to improve transfer efficiency. When the amount of addition of the external additive is less than 0.1 part by weight, it is impossible neither to provide sufficient fluidity for the toner nor to improve transfer efficiency. When the amount of addition of the external additive exceeds 3.0 parts by weight, the speed that the external additive is accumulated on the surface of the carrier gets fast and it becomes difficult to suppress reduction in the charge applying capability of the carrier against the toner even when the volume resistance values A and B of the carrier before and after the stirring test, and the volume resistance value C of the carrier core satisfy the above expression (1).

2. Two-Component Developer

A two-component developer (hereinafter, simply referred to also as a "developer") according to a second embodiment of the invention is manufactured by mixing the toner to which the external additive having a large particle size, an average primary particle size of which is 50 nm or more, is added and the resin coated carrier of the invention. Since the resin coated carrier of the invention is capable of stabilizing the charge amount of the toner over a long term even when being used with the toner to which the external additive having a large particle size is added, the two-component developer of the invention is capable of stably forming a high-quality image with little image defect such as fog.

A mixing ratio of the toner and the resin coated carrier is not particularly limited, but in consideration of using for a high-speed image forming apparatus capable of printing A4-size images on 40 sheets or more per minute, it is preferable to use the one in which the ratio of the volume average particle size of the resin coated carrier to the volume average particle size of the toner is 5 or more and the coverage 92 is about 50 to 75%. Thereby, charging property of the toner is stably maintained in a sufficiently excellent state, and it is possible to use as a suitable developer capable of stably forming a high-quality image over a long term even in a high-speed image forming apparatus.

It is possible to adjust a value of the coverage $\theta_2$ by a toner density in the developer. When the toner density in the developer is low (when the coverage $\theta_2$ is less than 50%), the charge amount of the toner is likely to increase, and when the toner density in the developer is high (when the coverage $\theta_2$ is greater than 75%), the charge amount of the toner is likely to decrease. It is therefore possible to adjust the charge amount to a certain level by using such phenomena. When the developer is provided in an actual apparatus to be used, however, as the toner density decreases, there occurs a problem of carrier attachment caused by an increase in a contact area of the carrier and a photoreceptor. Furthermore, as the toner density increases, toner scattering becomes serious with a decrease in the charge amount.

Specifically, a relationship between the coverage $\theta_2$ and the toner density is such that in a case where the volume average particle size of the toner is 6.5 μm and the volume average particle size of the resin coated carrier is 40 μm, when the coverage $\theta_2$ is 50 to 75%, about 6.9 to 10.4 parts by weight of the toner are included in the developer based on 100 parts by weight of the resin coated carrier. When performing high-speed development using such a developer, the amount of toner consumption and the amount of the supplied toner that is supplied in accordance with the toner consumption to a development tank of a developing device become maximum, respectively, and a supply-demand balance is still never damaged. When the toner in the developer is more than about 6.9 to 10.4 parts by weight based on 100 parts by weight of the carrier, the charge amount is likely to further lowered so that a desirable developing property is not obtained and the amount of toner consumption becomes greater than the amount of the supplied toner so that application of sufficient charges to the toner is inhibited to cause deterioration of image quality. In contrast, when the amount of the carrier is small, the charge amount is likely to be high so that the toner is less likely to separate from the carrier by an electric field, resulting in deterioration of image quality.

The total projection area of the toner in this embodiment is calculated as follows. The calculation is performed based on the volume average particle size obtained by using a Coulter counter (trade name: COULTER COUNTER MULTISIZER II, manufactured by Beckmann Coulter, Inc.) with a specific gravity of the toner being 1.0. That is, the number of toner particles in the weight of the toner to be mixed is calculated, and a value obtained by multiplication of the number of toner particles by the toner area (calculated assuming as a circular) is defined as the total projection area of the toner. In the same manner, the total surface area of the resin coated carrier is calculated from the weight of the carrier to be mixed based on the particle size obtained by using MICROTRAC (trade name: MICROTRAC MT3000, manufactured by Nikkiso CO., Ltd.) with a specific gravity of the carrier being 4.7. Furthermore, the total surface area of the carrier core is also calculated in the same manner as the total surface area of the resin coated carrier.

3. Developing Device

Figure 3:
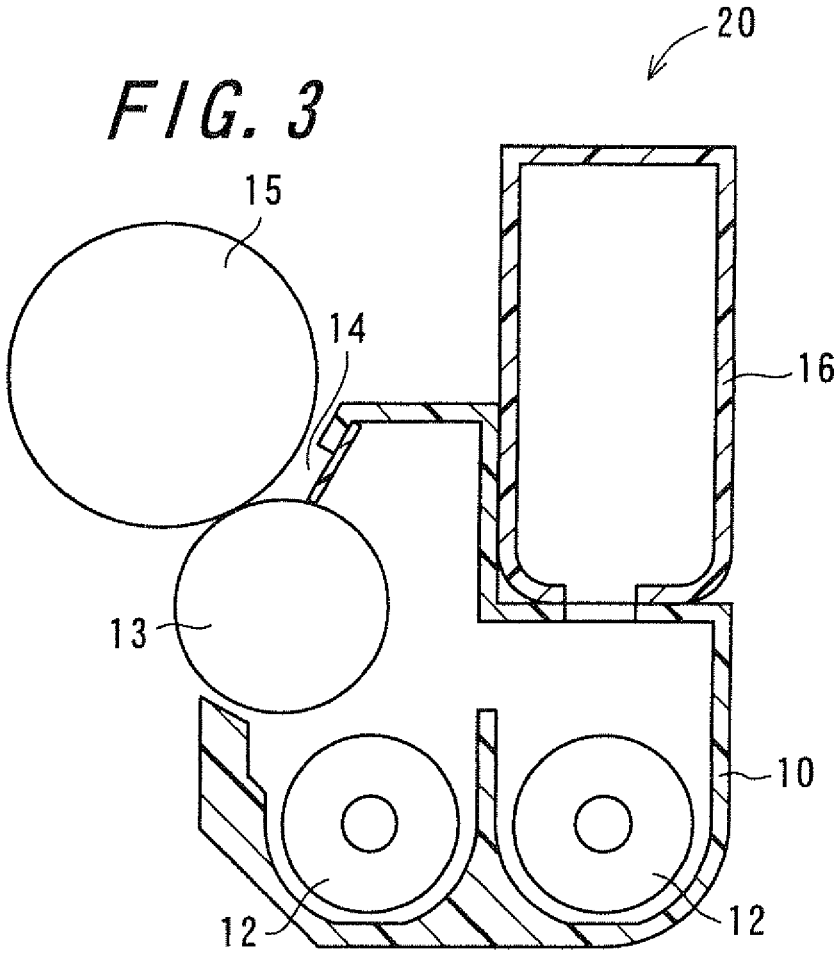
FIG. 3 is a sectional view showing a configuration of a developing device according to a third embodiment of the invention.

A developing device 20 according to a third embodiment of the invention develops an electrostatic latent image formed on an image bearing member to form a visible image by using the two-component developer of the invention. Since the two-component developer of the invention is capable of stabilizing the charge amount of the toner during long-term use, it is possible to realize a developing device capable of stably forming an excellent toner image without fog over a long term by using the two-component developer of the invention. FIG. 3 is a schematic view showing a structure of the developing device 20 according to this embodiment.

As shown in FIG. 3, the developing device 20 is provided with a development unit 10 for storing the developer 1, and a developer bearing member (a developer-transporting bearing member) 13 for transporting the developer to a photoreceptor 15 serving as an image bearing member.

The developer (two-component developer) according to this embodiment composed of the carrier and the toner according to this embodiment, which are supplied in advance into the development unit 10, is stirred to be charged by a stirring screw 12. The developer is transported to the developer bearing member 13, inside of which a magnet roller serving as a magnetic field generating section is provided, so as to be held on the surface of the developer bearing member 13. The developer held on the surface of the developer bearing member 13 is regulated to have a constant layer thickness by a developer regulating member 14 and transported to a development area formed in an area where the developer bearing member 13 and the photoreceptor 15 come close, and thereafter, an electrostatic charge image on the photoreceptor 15 is visualized through a reversal development method in an oscillating electric field formed by applying an AC bias voltage to the developer bearing member 13.

The toner consumption resulting from formation of the visible image is detected by using a toner density sensor (not shown) as a variation of the toner density which is a ratio of the weight of the toner to the weight of the developer, and the consumed amount is replenished from a toner hopper 16 until the toner density sensor (not shown) detects that the toner density has reached a predetermined regulation level so that the toner density of the developer inside the development unit 10 is maintained substantially at a constant level. Furthermore, in this embodiment, a gap between the developer bearing member 13 and the developer regulating member 14, and a gap between the developer bearing member 13 and the photoreceptor 15 in the development area may be set to, for example, 0.4 mm. This is certainly only an example and not limited to the value.

4. Image Forming Apparatus

Figure 4:
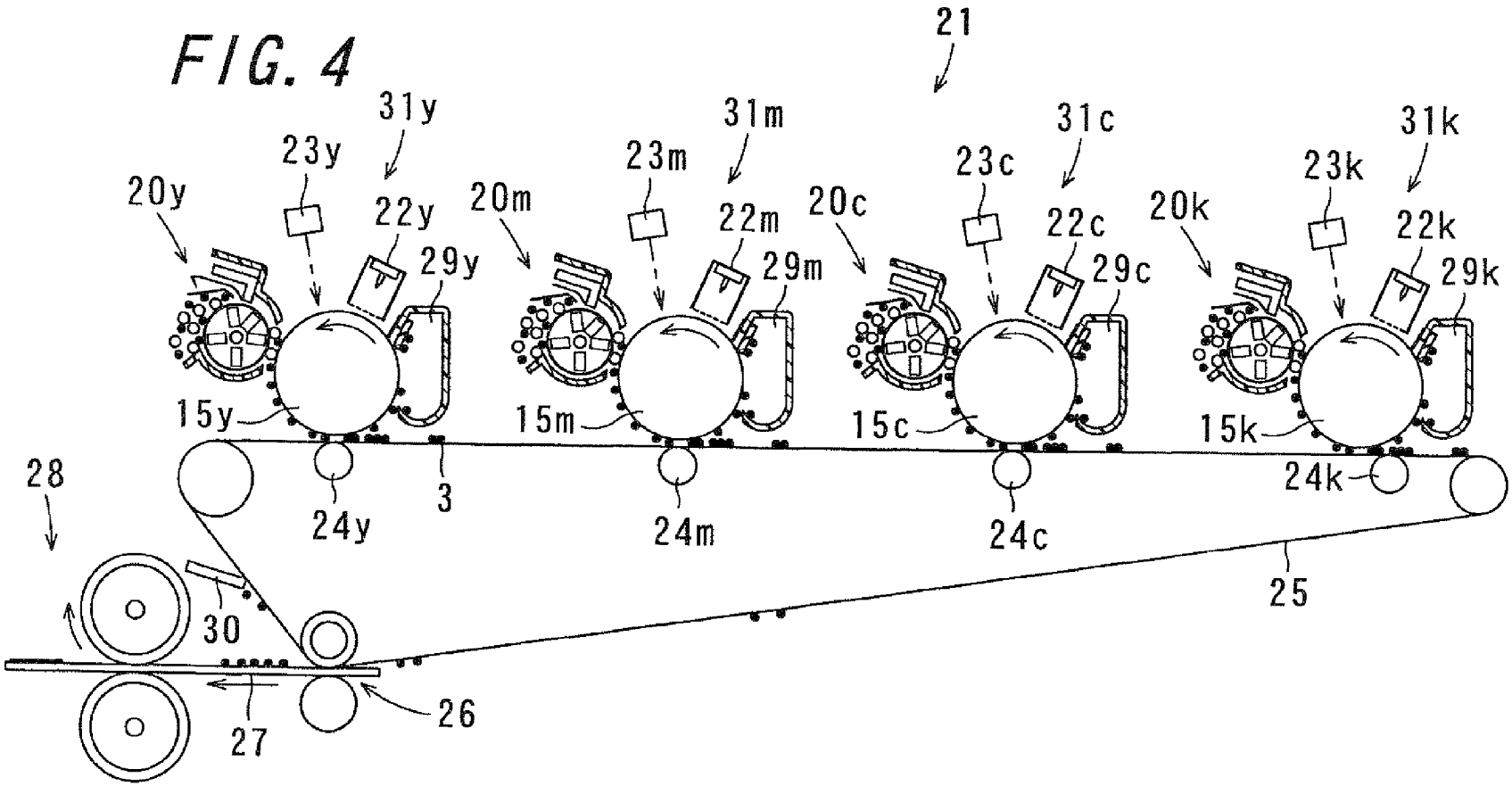
FIG. 4 is a sectional view showing a configuration of an image developing device according to a forth embodiment of the invention.

An image forming apparatus according to a fourth embodiment of the invention is provided with the developing device 20. For the structure other than the developing device 20, a structure of a known electrophotographic image forming apparatus is applicable. FIG. 4 is a schematic view showing a structure of an image forming apparatus 21 according to the fourth embodiment of the invention. The image forming apparatus 21 includes a visible image forming unit 31, a fixing section and a cleaning section. In accordance with image information of respective colors of black (b), cyan (c) magenta (m), and yellow (y) which are contained in color image information, there are provided respectively four sets of members of the visible image forming unit 31. The four sets of respective members provided for the respective colors are distinguished herein by giving alphabets indicating the respective colors to the end of the reference numerals, and only the reference numerals are shown when the sets are collectively referred to. The visible image forming unit 31 includes an image bearing member, a charging section, an exposure section and a transfer section.

The photoreceptor 15 serving as the image bearing member is a roller-shaped member having a photosensitive layer capable of forming an electrostatic charge image on the surface thereof. A charging device 22 serving as the charging section charges the surface of the photoreceptor 15 to a predetermined-potential. A laser light irradiating section 23 serving as the exposure section irradiates the surface of the photoreceptor 15 in a charged state with signal light corresponding to the image information to form an electrostatic charge image (electrostatic latent image) on the surface of the photoreceptor 15. The transfer section includes a primary transfer device 24 and a secondary transfer device 26, and the primary transfer device 24 transfers a toner image on the surface of the photoreceptor 15 that is developed by the toner 3 supplied from the developing device 20, to an intermediate transfer belt 25 serving as an intermediate transfer body. The secondary transfer device 26 transfers the toner image transferred to the intermediate transfer belt 25 to a recording medium 27. A fixing device 28 serving as the fixing section fixes the toner image on the surface of the recording medium 27 onto the recording medium 27. The cleaning section includes a cleaning device for photoreceptor 29 and a cleaning device for transfer 30, and the cleaning device for photoreceptor 29 removes the toner 3, paper dust and the like remaining on the surface of the photoreceptor 15 after the transfer of the toner image to the recording medium 27. The cleaning device for transfer 30 removes the redundant toner 3 and the like adhering to the intermediate transfer belt.

To develop an electrostatic charge image, a developing step for visualizing the electrostatic charge image on the surface of the photoreceptor 15 through a reversal development method is executed for each color of the toner and a plurality of toner images having different colors are overlaid on the intermediate transfer belt 25 to form a multi-color toner image. Although an intermediate transfer method using the intermediate transfer belt 25 is employed in this embodiment, a structure to transfer a toner image directly to a recording medium from the photoreceptor 15 may be employed.

According to the image forming apparatus 21 according to this embodiment, the image forming apparatus 21 provided with the developing device 20 of the invention that is capable of forming a toner image without fog on the photoreceptor 15 as described above is realized. By forming an image using such an image forming apparatus 21, it is possible to stably form a high-quality image without fog over a long term.

EXAMPLES

In the embodiment, the volume average particle size and the saturated charge amount of the carrier core, the thickness of the resin coating layer, and the saturated charge amount of the resin coated carrier were measured as follows.

(Volume Average Particle Size)

The volume average particle size of the carrier core was measured by using MICROTRAC (trade name: MT-3000, Nikkiso CO., Ltd.). Approximately 10 to 15 mg of a measurement sample was added to a 10 mL solution having 5% EMULGEN 109P (polyoxyethylene lauryl ether HLB 13.6, manufactured by Kao Corporation), the mixture was dispersed by an ultrasonic dispersing device for one minute, and approximately 1 mL of the mixture was added to a predetermined point of the MICROTRAC and then stirred for one minute, and thereafter, it was confirmed that the scattered light intensity was stable to perform the measurement.

(Thickness of Resin Coating Layer)

The thickness of the resin coating layer was obtained such that the resin coated carrier was pulverized in a mortar, a cross-section of the resin coated carrier thus pulverized was observed by using a scanning electron microscope (product name: VE-9800, manufactured by Keyence) at 5 KV acceleration voltage and a magnification of 10,000 times, and an average value of the thickness at optional 10 points of the resin coating layer was calculated.

(Saturated Charge Amount)

The saturated charge amount of the carrier core was a charge amount measured such that the carrier core and the toner were placed in a resin-made cylindrical container to have the coverage $\theta_1$ of 70%, mixed and stirred on a double-shaft driving plastic container rotation stand at 200 rpm for two hours, then the carrier core and the toner were collected to be measured with a suction type charge amount measuring device (trade name: 210H-2A Q/M Meter, manufactured by TREK INC.). The saturated charge amount of the resin coated carrier was also a charge amount that was measured in the same manner.

Examples according to the invention and comparative examples will be described below. The invention is not limited to the examples, unless exceeding the scope thereof. Hereinafter, a "part" refers to a "part by weight". Further, unless otherwise mentioned, "%" refers to "% by weight".

[Preparation of Toner]

The following describes the preparation of 3 kinds of toners (toners 1 to 3).

—Toner 1

Polyester serving as a binder resin, a pigment, a release agent and a charge control agent (trade name: LR-147, manufactured by Japan Carlit Co., Ltd) were dry-mixed and melt-kneaded, followed by a pulverizing step and a classifying step, to prepare a toner particle. Two kinds of silica fine particles subjected to the hydrophobic treatment each of which has an average primary particle size of 0.1 μm and of 12 nm (hereinafter, referred to also as a "hydrophyobized silica fine particle") were added to the toner particle to prepare a negatively-charged magenta toner (non-magnetic magenta toner) having a volume average particle size of 6.5 μm.

—Toner 2

Toner 2 was prepared in the same manner as Toner 1 except that a hydrophyobized silica fine particle having an average primary particle size of 50 nm was used in place of the hydrophobized silica fine particle having an average primary particle size of 0.1 μm.

—Toner 3

Toner 3 was prepared in the same manner as Toner 1 except that only the hydrophyobized silica having an average primary particle size of 12 nm was used as the external additive instead of using the hydrophobized silica fine particle having an average primary particle size of 0.1 μm.

[Preparation of Carrier]

Four kinds of ferrite cores each having a volume average particle size, a volume resistance rate and a saturated charge amount as shown in Table 1 were prepared as carrier cores A to E. As the carrier core, a carrier core placed in the market is usable. Furthermore, it is also possible to prepare by washing a resin coated carrier placed in the market with a toluene. Specifically, the toluene was added to the resin coated carrier at a rate of the weight of the toluene to the weight of the resin coated carrier of 10 to 3, the obtained mixture was washed by using an ultrasonic cleaner for 30 minutes to separate the toluene from the carrier, subsequently, the process that the toluene was added again to the carrier at the same rate and the obtained mixture was washed by using the ultrasonic cleaner for 30 minutes in the same manner was repeated five times to separate the toluene from the carrier, and thereafter, the carrier thus washed was dried so that the carrier core could be prepared.

TABLE 1

| Carrier core | Volume average particle size (μm) | Volume resistance value (Ω/cm) | Saturated charge amount (μC/g) |
|---|---|---|---|
| A | 45 | $2.9 \times 10^7$ | 27 |
| B | 55 | $9.2 \times 10^8$ | 32 |
| C | 35 | $1.6 \times 10^8$ | 38 |
| D | 30 | $1.5 \times 10^7$ | 31 |
| E | 60 | $9.0 \times 10^7$ | 30 |

(Resin Coated Carrier 1)

0.375 part of a silicone resin F (trade name: KR 240, manufactured by Shin-Etsu Chemical Co., Ltd.) and 0.375 part of a silicone resin G (trade name: KR 251, Shin-Etsu Chemical Co., Ltd.) were dissolved in 12 parts of a toluene, then 0.0375 part of a conductive particle (trade name: VULCAN XC-72, manufactured by Cabot Corporation) and 0.025 part of a coupling agent (trade name: AY43-059, manufactured by Dow Corning Toray Co., Ltd.) were internally added or dispersed thereto to prepare a coat-resin liquid. Through a dipping method, the surface of 100 parts of the carrier core was coated using 12.8 parts of the coat-resin liquid. Subsequently, followed by a curing process with a curing temperature of 200° C. and a curing time of 1 hour, Resin coated carrier 1 was prepared by shifting through a sieve having 150 μm meshes.

(Resin Coated Carriers 2 to 18)

Resin coated carriers 2 to 18 were prepared in the same manner as Resin coated carrier 1 except that at least any one of a kind of the silicone resin, the amount of addition of the silicone resin, the amount of addition of the conductive particle, the amount of addition of the coupling agent, or the amount of addition of the curing catalyst was changed as shown in Table 2.

The silicone resin and the curing catalyst used in the preparation of Resin coated carriers 1 to 18 were specifically the followings:

Silicone resin F, trade name: KR 240 manufactured by Shin-Etsu Chemical Co., Ltd.

Silicone resin G, trade name: KR 251 manufactured by Shin-Etsu Chemical Co., Ltd.

Silicone resin H, trade name: KR 350 manufactured by Shin-Etsu Chemical Co., Ltd.

Silicone resin I, trade name: KR 400 manufactured by Shin-Etsu Chemical Co., Ltd.

Silicone resin J, trade name: KR 9706 manufactured by Shin-Etsu Chemical Co., Ltd.

Curing catalyst K, trade name: D-20 manufactured by Shin-Etsu Chemical Co., Ltd.

Curing catalyst L, trade name: CAT-AC manufactured by Shin-Etsu Chemical Co., Ltd.

Table 2 shows kinds and used amounts (solid content) of the carrier core and the silicone resin, a used amount (solid content) of each additive and the thickness of the resin coating layer.

TABLE 2

| Resin | Carrier core | | Coat-resin liquid | | | | | | Resin coated carrier | |
|---|---|---|---|---|---|---|---|---|---|---|
| | | | Silicone resin | | Conductive particle | Coupling agent | Curing catalyst | | Thickness of resin coating | Volume average |
| coated carrier | Kind | Used amount (part) | Kind | Used amount (part) | Used amount (part) | Used amount (part) | Kind | Used amount (part) | layer (μM) | particle size (μm) |
| 1 | A | 100 | F<br>G | 0.375<br>0.375 | 0.0375 | 0.0225 | — | None | 0.28 | 45 |
| 2 | A | 100 | H<br>I | 0.4<br>1.6 | 0.1 | 0.1 | K | 0.06 | 0.60 | 45 |
| 3 | B | 100 | H<br>I | 0.1<br>0.6 | 0.035 | 0.035 | K | 0.021 | 0.25 | 55 |
| 4 | C | 100 | F<br>G | 0.8<br>0.8 | 0.08 | 0.048 | — | None | 0.47 | 35 |
| 5 | C | 100 | F<br>G | 0.3<br>0.3 | 0.03 | 0.018 | — | None | 0.18 | 35 |
| 6 | A | 100 | F<br>G | 0.3<br>0.3 | 0.03 | 0.048 | — | None | 0.23 | 45 |
| 7 | A | 100 | F<br>G | 0.6<br>1.2 | 0.09 | 0.054 | — | None | 0.68 | 45 |
| 8 | C | 100 | F<br>G | 0.5<br>0.5 | 0.05 | 0.01 | — | None | 0.29 | 35 |

TABLE 2-continued

| Resin coated carrier | Carrier core Kind | Carrier core Used amount (part) | Coat-resin liquid: Silicone resin Kind | Silicone resin Used amount (part) | Conductive particle Used amount (part) | Coupling agent Used amount (part) | Curing catalyst Kind | Curing catalyst Used amount (part) | Resin coated carrier: Thickness of resin coating layer (μM) | Volume average particle size (μm) |
|---|---|---|---|---|---|---|---|---|---|---|
| 9 | B | 100 | H<br>I | 0.05<br>0.35 | 0.02 | 0.02 | K | 0.012 | 0.13 | 55 |
| 10 | D | 100 | F<br>G | 0.375<br>0.375 | 0.0375 | 0.0225 | — | None | 0.19 | 30 |
| 11 | E | 100 | F<br>G | 0.375<br>0.375 | 0.0375 | 0.0225 | — | None | 0.38 | 60 |
| 12 | B | 100 | F<br>G | 0.25<br>0.25 | None | 0.015 | — | None | 0.23 | 55 |
| 13 | A | 100 | F<br>G | 0.15<br>0.15 | 0.015 | 0.009 | — | None | 0.11 | 45 |
| 14 | A | 100 | F<br>G | 1.125<br>1.125 | 0.1125 | 0.0675 | — | None | 0.84 | 45 |
| 15 | A | 100 | J | 0.5 | 0.0125 | None | L | 0.005 | 0.17 | 45 |

Example 1

Resin coated carrier 1 and Toner 1 were placed in a resin-made cylindrical container to have the coverage $\theta_2$ of 70%, and then mixed and stirred on a double-shaft driving plastic container rotation stand under the conditions of 200 rpm and for two hours, so that a two-component developer including the carrier of Example 1 was prepared.

Example 2, Comparative Examples 1 to 4

Two-component developers each including the carrier of Example 2 and Comparative Examples 1 to 4 were prepared in the same manner as Example 1 except that at least any one of a kind of the toner or a kind of the resin coated carrier was changed as shown in Table 3.

Examples 3 to 13, Comparative Examples 5 and 6

Two-component developers each including the carrier of Examples 3 to 13 and Comparative Examples 5 and 6 were prepared in the same manner as Example 1 except that a kind of the resin including carrier was changed as shown in Table 4.

<Evaluation>

First, the influence of the particle size of the external additive added to the toner was evaluated on life charge stability and transfer efficiency by using two-component developers each including the carrier of Examples 1 and 2, and Comparative Examples 1 to 4.

(Life Charge Stability)

Two-component developers each including the carrier of Examples 1 and 2, and Comparative Examples 1 to 4 were set in a copier (printing speed of 50 ppm <for color> and 62 ppm <for monochrome>, trade name: MX-6201N manufactured by Sharp Corporation) which has a two-component developing device, and after 50000 (hereinafter, referred to as "50 k") prints of an image with a coverage rate of 5% were produced at normal temperature and normal humidity, and the charge amounts of the two-component developers were measured. The charge amounts were measured by using a suction type charge amount measuring device. With respect to a difference from an initial charge amount in an absolute value, the case of being 3 μC/g or less was evaluated as "Good"; the case of exceeding 3 μC/g and being 5 μC/g or less was evaluated as "Not bad"; and the case of being greater than 5 μC/g was evaluated as "Poor".

(Transfer Efficiency)

Transfer efficiency of two-component developers each including the carrier of Example 1 and 2, and Comparative Examples 1 to 4 were calculated after 50 k prints of an image were produced in the same manner as the method for evaluating the life charge stability. The transfer efficiency T (%) was calculated by the following expression (3), and with respect to the transfer efficiency, the case of being 90% or more was evaluated as "Good", and the case of being less than 90% was evaluated as "Poor":

$$T(\%)=[Mp/(Md+Mp)]\times 100 \quad (3).$$

In the expression, Mp represents the weight of the toner on the surface of paper on which a predetermined chart has been copied. Md represents the weight of the toner remaining on the surface of the image bearing member (electrophotographic photoreceptor) when the predetermined chart is copied. The predetermined chart is the one in which patches of 4 cm by 4 cm are arranged at four corners of A4 paper (arranged 1.5 cm each inside from the edges of the paper) and a center part thereof. The weight of the toner remaining on the surface of the image bearing member was obtained by sucking the toner on the surface of the image bearing member using the suction type charge amount measuring device and measuring the amount of the toner thus sucked. Furthermore, the amount of the toner on the surface of the paper was also obtained in the same manner.

Table 3 shows a ratio X of the saturated charge amount of the resin coated carrier and the toner to the saturated charge amount of the carrier core and the toner, a variation of a volume resistance value Y, as well as evaluation results of life charge stability and transfer efficiency in two-component developers each including the carrier of Examples 1 and 2, and Comparative Examples 1 to 4. The variation of a volume resistance value Y is defined as a value represented by the following expression:

$$Y=-\log[(A/C)/(B/C)]$$

(wherein, a volume resistance value (Ω/cm) of the resin coated carrier in an electric field of 1000 V/cm after a stirring test is A, a volume resistance value (Ω/cm) of the resin coated carrier in an electric field of 1000 V/cm before the stirring test is B, and a volume resistance value (Ω/cm) of the core in an electric field of 1000 V/cm is C).

TABLE 3

| | | | | Variation of | Life charge stability | | | Transfer efficiency | |
|---|---|---|---|---|---|---|---|---|---|
| | Kind of toner | Kind of resin coated carrier | Ratio of saturated charge amount X | volume resistance value Y | Initial stage Charge amount (μC/g) | After 50k prints Charge amount (μC/g) | Evaluation | Transfer efficiency T (%) | Evaluation |
| Ex. 1 | Toner 1 | Resin coated carrier 1 | 0.9 | 1.6 | 35 | 33 | Good | 94 | Good |
| Ex. 2 | Toner 2 | Resin coated carrier 1 | 0.95 | 1.6 | 34 | 33 | Good | 92 | Good |
| Comp. Ex. 1 | Toner 3 | Resin coated carrier 1 | 1.05 | 1.6 | 35 | 35 | Good | 81 | Poor |
| Comp. Ex. 2 | Toner 1 | Resin coated carrier 7 | 0.85 | 0.35 | 25 | 18 | Poor | 91 | Good |
| Comp. Ex. 3 | Toner 2 | Resin coated carrier 7 | 0.9 | 0.35 | 30 | 20 | Poor | 90 | Good |
| Comp. Ex. 4 | Toner 3 | Resin coated carrier 7 | 0.95 | 0.35 | 31 | 29 | Poor | 82 | Poor |

As shown in Table 3, it was found from Comparative Examples 1 and 4 in which the external additive of 50 nm or more is not included in the toner that life charge stability was good but transfer efficiency was poor. Further, it was found from Examples 1 and 2 and Comparative Examples 2 and 3 in which the external additive of 50 nm or more is included in the toner that transfer efficiency was good, and life charge stability was also good when the variation of a volume resistance value Y was within a range of 0.5 or more and 2.5 or less, whereas life charge stability was poor when the variation of a volume resistance value Y was outside the range of 0.5 or more and 2.5 or less.

Next, life charge stability, an image density, whiteness, rising property of charging, transfer efficiency, carrier attachment and granularity were evaluated using two-component developers each including the carrier of Examples 1, 3 to 13 and Comparative Examples 2, 5 and 6. The evaluation method and the evaluation standard for life charge stability and transfer efficiency were the same as the evaluation method and the evaluation standard for life charge stability and transfer efficiency of two-component developers each including the carrier of Examples 1, 2 and Comparative Examples 1 to 4.

(Image Density)

50 k prints of an image were produced in the same manner as the evaluation method for the life charge stability of two-component developers each including the resin coated carrier of Examples 1 and 2 and Comparative Examples 1 to 4 and the image density of an image region was measured by using an X-Rite 938 spectrodensitometer. With respect to the image density, the case of being 1.4 or more was evaluated as "Good", the case of being 1.3 or more and less than 1.4 was evaluated as "Not bad", and the case of being less than 1.3 was evaluated as "Poor".

(Whiteness)

50 k prints of an image were produced in the same manner as the evaluation method for life charge stability of two-component developers each including the resin coated carrier of Examples 1 and 2 and Comparative Examples 1 to 4, whiteness of a non-image region was measured. With respect to the whiteness, tristimulus values X, Y, and Z were obtained by using a SZ90 spectral color difference meter manufactured by Nippon Denshoku Kogyo CO., Ltd., and with respect to the value of Z, the case of being 0.5 or less was evaluated as "Good", the case of being greater than 0.5 and 0.7 or less was evaluated as "Not bad", and the case of being greater than 0.7 was evaluated as "Poor".

(Rising Property of Charging)

Two-component developers each including the resin coated carrier of Examples 3 to 13 and Comparative Examples 5 and 6 were contained in a 5 ml glass bottle, which were stirred in a 32 rpm rotary cultivator for 1 minute, and then the two-component developers were gathered and the charge amounts thereof were measured with a suction type charge amount measuring device (TREK INC.: 210H-2A Q/M Meter). The charge amounts thereof were measured in the same manner after stirring for 3 minutes. With respect to the difference between absolute values of the charge amounts after 1 minute and after 3 minutes, the case of being less than 5 μC/g was evaluated as "Good", the case of being 5 μC/g or more and 7 μC/g or less was evaluated as "Not bad", and the case of being greater than 7 μC/g was evaluated as "Poor".

(Carrier Attachment)

After 50 k prints of an image were produced in the same manner as the evaluation method for life charge stability of two-component developers each including the resin coated carrier of Examples 1 and 2 and Comparative Examples 1 to 4, the number of carriers attached in a constant area (297 mm×24 mm) of a non-image region on the image bearing member was obtained. When obtaining the number of carriers attached, a DC bias voltage applied to the developer bearing member was 200 V, an AC bias voltage was 400 V, a frequency was 9 kHz and the surface of the image bearing member was not charged. With respect to the number of carriers attached, the case of being less than 15 was evaluated as "Good", the case of being 15 or more and 20 or less was evaluated as "Not bad", and the case of being greater than 20 was evaluated as "Poor".

(Granularity)

Two-component developers each including the resin coated carrier of Examples 1, and 3 to 13 and Comparative Examples 2, 5 and 6 were set in a copier (trade name: MX-6201N manufactured by Sharp Corporation) which has a two-component developing device, and after 50 k prints of an image were produced in the same manner as the evaluation method for life charge stability, a test chart of the image was printed to measure score values of granularity with color differences from white color of 30, 50, and 70 by using an automatic printer image quality evaluation system (trade name: APQS, manufactured by Oji Scientific Instruments). The lower score value of the granularity shows that the image has little roughness and is of high quality. Here, with respect to the maximum value of the respective score values of color difference, the case of being less than 115000 was evaluated as "Good", the case of being 11500 or more and 12000 or less was evaluated as "Not bad", and the case of being greater than 12000 was evaluated as "Poor".

(Comprehensive Evaluation)

A comprehensive evaluation was conducted with respect to evaluation results of the life charge stability, the image density, the whiteness, the rising property of charging, the transfer efficiency, the carrier attachment and the granularity, by giving "Excellent" for the case where all evaluation results were "Good", "Good" for the case where there were one evaluation result of "Not bad" and no evaluation result of "Poor", "Not bad" for the case where there were two or more evaluation results of "Not bad" and no evaluation result of "Poor", and "Poor" for the case that there was an evaluation result of "Poor". The case with the comprehensive evaluation result of "Good" or "Not bad" was determined as usable.

Table 4 shows a ration of a saturated charge amount X, a variation of a volume resistance value Y, evaluation results of life charge stability, an image density, whiteness, rising property of charging, transfer efficiency, carrier attachment and granularity, as well as the overall evaluation result in two-component developers each including the resin coated carrier of Examples 1 and 3 to 13 and Comparative Examples 2, 5 and 6,

TABLE 4

| | | | | Life charge stability | | | Image density | |
|---|---|---|---|---|---|---|---|---|
| | Kinds of resin coated carrier | Variation of volume resistance value Y | Ratio of saturated charge amount X | Initial charge amount (μC/g) | Charge amount after printing 50k sheets (μC/g) | Evaluation | Image density | Evaluation |
| Ex. 1 | Resin coated carrier 1 | 1.6 | 0.9 | 35 | 33 | Good | 1.4 | Good |
| Ex. 3 | Resin coated carrier 2 | 0.55 | 1.05 | 31 | 26 | Not bad | 1.5 | Good |
| Ex. 4 | Resin coated carrier 3 | 2.3 | 0.95 | 33 | 32 | Good | 1.4 | Good |
| Ex. 5 | Resin coated carrier 4 | 0.55 | 0.7 | 27 | 23 | Not bad | 1.6 | Good |
| Ex. 6 | Resin coated carrier 5 | 2.25 | 0.65 | 30 | 28 | Good | 1.5 | Good |
| Ex. 7 | Resin coated carrier 10 | 1.55 | 0.8 | 36 | 33 | Good | 1.4 | Good |
| Ex. 8 | Resin coated carrier 11 | 1.2 | 0.95 | 34 | 32 | Good | 1.4 | Good |
| Ex. 9 | Resin coated carrier 12 | 1.5 | 0.8 | 29 | 28 | Good | 1.5 | Good |
| EX. 10 | Resin coated carrier 13 | 2.4 | 0.7 | 34 | 32 | Good | 1.4 | Good |

| | Whiteness | | Rising property of charging | | | Transfer efficiency | | Carrier attachment | | Granularity | | Compre- |
|---|---|---|---|---|---|---|---|---|---|---|---|---|
| | Value of Z | Evaluation | Charge amount after 1 minute (μC/g) | Charge amount after 3 minutes (μC/g) | Evaluation | Transfer efficiency T (%) | Evaluation | Number | Evaluation | Score value | Evaluation | hensive evaluation |
| Ex. 1 | 0.3 | Good | 25 | 29 | Good | 94 | Good | 9 | Good | 11300 | Good | Excellent |
| Ex. 3 | 0.4 | Good | 26 | 29 | Good | 92 | Good | 5 | Good | 11450 | Good | Good |
| Ex. 4 | 0.3 | Good | 29 | 31 | Good | 93 | Good | 15 | Not bad | 11450 | Good | Good |
| Ex. 5 | 0.5 | Good | 17 | 21 | Good | 91 | Good | 8 | Good | 11400 | Good | Good |
| Ex. 6 | 0.4 | Good | 20 | 24 | Good | 92 | Good | 18 | Not bad | 11350 | Good | Good |
| Ex. 7 | 0.3 | Good | 25 | 29 | Good | 93 | Good | 19 | Not bad | 11250 | Good | Good |
| Ex. 8 | 0.3 | Good | 24 | 27 | Good | 92 | Good | 7 | Good | 11950 | Not bad | Good |
| Ex. 9 | 0.4 | Good | 16 | 23 | Not bad | 92 | Good | 10 | Good | 11450 | Good | Good |
| Ex. 10 | 0.3 | Good | 25 | 28 | Good | 93 | Good | 18 | Not bad | 11350 | Good | Good |

| | | | | Life charge stability | | | Image density | |
|---|---|---|---|---|---|---|---|---|
| | Kinds of resin coated carrier | Variation of volume resistance value Y | Ratio of saturated charge amount X | Initial charge amount (μC/g) | Charge amount after printing 50k sheets (μC/g) | Evaluation | Image density | Evaluation |
| Ex. 11 | Resin coated carrier 15 | 1.5 | 1.1 | 29 | 27 | Good | 1.5 | Good |
| Ex. 12 | Resin coated carrier 6 | 2.1 | 1.25 | 42 | 37 | Not bad | 1.3 | Not bad |
| Ex. 13 | Resin coated carrier 8 | 1.2 | 0.5 | 21 | 26 | Not bad | 1.5 | Good |
| Comp. Ex. 2 | Resin coated carrier 7 | 0.35 | 0.85 | 25 | 18 | Poor | 1.6 | Good |

TABLE 4-continued

| | | | | | | | | |
|---|---|---|---|---|---|---|---|---|
| Comp. Ex. 5 | Resin coated carrier 9 | 2.7 | 0.8 | 32 | 31 | Good | 1.4 | Good |
| Comp. Ex. 6 | Resin coated carrier 14 | 0.25 | 0.85 | 30 | 16 | Poor | 1.5 | Good |

| | Whiteness | | Rising property of charging | | | Transfer efficiency | | Carrier attachment | | Granularity | | Comprehensive evaluation |
|---|---|---|---|---|---|---|---|---|---|---|---|---|
| | Value of Z | Evaluation | Charge amount after 1 minute (μC/g) | Charge amount after 3 minutes (μC/g) | Evaluation | Transfer efficiency T (%) | Evaluation | Number | Evaluation | Score value | Evaluation | |
| Ex. 11 | 0.4 | Good | 19 | 25 | Not bad | 92 | Good | 14 | Good | 11400 | Good | Good |
| Ex. 12 | 0.3 | Good | 36 | 37 | Good | 93 | Good | 13 | Good | 11300 | Good | Not bad |
| Ex. 13 | 0.4 | Good | 10 | 17 | Not bad | 90 | Good | 11 | Good | 11550 | Not bad | Not bad |
| Comp. Ex. 2 | 0.7 | Not bad | 15 | 21 | Not bad | 91 | Good | 5 | Good | 12200 | Poor | Poor |
| Comp. Ex. 5 | 0.4 | Good | 28 | 30 | Good | 92 | Good | 23 | Poor | 11450 | Good | Poor |
| Comp. Ex. 6 | 0.8 | Poor | 20 | 25 | Not bad | 85 | Poor | 3 | Good | 12300 | Poor | Poor |

As shown in Table 4, it was found that the charge amount was stabilized over long-term use in Examples 1, and 3 to 13 in which the variation of a volume resistance value Y was 0.5 or more and 2.5 or less, and further, the charge amount was more stabilized in Examples 1, 4, and 6 to 11 in which the ratio of a saturated charge amount X was 0.6 or more and 1.1 or less. In Examples 3 and 5, since the variation of a volume resistance value Y was close to the lower limit and the effect of carrier scraping was slightly low, reduction in the charge amount was considered to be relatively large. The effect of the carrier scraping means an effect that enables prevention of reduction in the charge applying capability of the carrier due to scraping of the resin coating layer.

In Example 7 in which the resin coated carrier had a relatively small volume average particle size, the carrier attachment occurred slightly, whereas in Example 8 in which the resin coated carrier had a relatively large volume average particle size, the granularity was slightly lowered. In Example 9 in which no conductive particle was included, the rising property of charging was slightly lowered. Also in Example 11 in which no coupling agent was included, the rising property of charging was slightly lowered.

It was found that, when a value of the variation of a volume resistance value Y was 2.5 or more like in Comparative Example 5, the charge amount was stabilized, but the carrier attachment was increased after 50 k prints due to a decrease in the volume resistance value of the carrier.

Further, it was found that, when the variation of a volume resistance value Y was less than 0.5 like in Comparative Examples 2 and 6, life charge stability, whiteness and granularity were lowered. In addition, transfer efficiency was also lowered in Comparative Example 6. This was because the charge amount after 50 k prints was significantly lowered in Comparative Example 6.

The invention will not be limited to the above-mentioned embodiments and respective examples, and various modifications can certainly be made within the scope of the claims. That is, the embodiments and the examples that are obtained by combining technical sections appropriately modified within the scope of the claims are also included in the technical scope of the invention.

What is claimed is:

1. A two-component developer system comprising a resin coated carrier and a toner, the resin coated carrier comprising:

a carrier core; and a resin coating layer on a surface of the carrier core, the resin coated carrier being used with a toner in which an external additive having an average primary particle size of 50 nm or more is added to a toner particle, wherein the resin coating layer comprises two or more of a cross-linked silicone resin in combination, and the following expression (1) is satisfied:

$$0.5 \leq -\log\{(A/C)/(B/C)\} \leq 2.5 \quad (1)$$

in which A represents a volume resistance value (Ω/cm) of the resin coated carrier in an electric field of 1000 V/cm that is obtained by conducting a stirring test, B represents a volume resistance value Ω/cm) of the resin coated carrier in an electric field of 1000 V/cm before the stirring test, and C represents a volume resistance value (Ω/cm) of the carrier core in an electric field of 1000 V/cm, wherein the stirring test is a test in which a developer that is obtained by mixing the resin coated carrier core and the toner so that a ratio of an entire projection area of the toner to an entire surface area of the carrier core is 70% is placed in a glass bottle, and mixed and stirred by a mixer mill under conditions of 26.3 Hz for three hours, wherein the carrier core is a ferrite and has a volume resistance value of $1.0\times10^7$ Ω/cm or more and $1.0\times10^9$ Ω/cm or less.

2. The two-component developer system of claim 1, wherein a second external additive is added to the toner particle, the second external additive having a smaller average primary particle size than the external additive.

3. The two-component developer system of claim 1, wherein a thickness of the resin coating layer is in a range of 0.15 μm or more and 0.60 μm or less.

4. The two-component developer system of claim 1, wherein the resin coating layer includes a silicone resin or an acryl-modified silicone resin.

5. The two-component developer system of claim 4, wherein the resin coating layer includes a cross-linked silicone resin.

6. The two-component developer system of claim 1, wherein a ratio of a saturated charge amount of the resin coated carrier and the toner to a saturated charge amount of the carrier core and the toner is in a range of 0.6 or more and 1.1 or less.

7. The two-component developer system of claim 1, wherein the resin coating layer further includes conductive particles.

8. The two-component developer system of claim 1, wherein a volume average particle size of the resin coated carrier is in a range of 35 μm or more and 55 μm or less.

* * * * *